US008965662B2

(12) United States Patent
Aoki et al.

(10) Patent No.: US 8,965,662 B2
(45) Date of Patent: Feb. 24, 2015

(54) ABNORMALITY DETERMINING APPARATUS FOR AIR-FUEL RATIO SENSOR

(75) Inventors: Takeshi Aoki, Wako (JP); Atsuhiro Miyauchi, Wako (JP); Michinori Tani, Wako (JP); Seiji Watanabe, Wako (JP); Tooru Sekiguchi, Wako (JP); Hiroyuki Ando, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 395 days.

(21) Appl. No.: 13/436,996

(22) Filed: Apr. 2, 2012

(65) Prior Publication Data

US 2012/0310512 A1 Dec. 6, 2012

(30) Foreign Application Priority Data

May 31, 2011 (JP) ..... 2011-122470

(51) Int. Cl.
*F02D 41/22* (2006.01)
*F02D 41/14* (2006.01)
*F02D 41/12* (2006.01)

(52) U.S. Cl.
CPC ..... *F02D 41/1495* (2013.01); *F02D 41/123* (2013.01); *F02D 41/126* (2013.01)
USPC ..... 701/103; 701/107; 701/109

(58) Field of Classification Search
CPC .... F02D 41/1495; F02D 41/123; F02D 41/22
USPC ..... 123/672, 688, 690, 703, 704, 443; 701/103, 107, 109; 60/276; 73/114.71, 73/114.72, 114.73
See application file for complete search history.

(56) References Cited

U.S. PATENT DOCUMENTS 5,289,678 A * 3/1994 Grutter ..... 60/277
5,865,026 A * 2/1999 Davey et al. ..... 60/274

FOREIGN PATENT DOCUMENTS

JP 2003-020989 1/2003
JP 2006-070778 3/2006
JP 2010-249003 11/2010

OTHER PUBLICATIONS

Japanese Office Action for corresponding JP Application No. 2011-122470, May 2, 2013.

* cited by examiner

*Primary Examiner* — Hai Huynh
(74) *Attorney, Agent, or Firm* — Mori & Ward, LLP

(57) ABSTRACT

An abnormality determining apparatus includes an air-fuel ratio controller, an output change period parameter calculator, an output change amount extremum calculator, and an abnormality determining device. The abnormality determining device is configured to determine an abnormality of an air-fuel ratio sensor based on a relationship between an output change period parameter and an output change amount extremum.

19 Claims, 20 Drawing Sheets

ABNORMALITY DETERMINING APPARATUS FOR AIR-FUEL RATIO SENSOR

CROSS-REFERENCE TO RELATED APPLICATIONS

The present application claims priority under 35 U.S.C. §119 to Japanese Patent Application No. 2011-122470, filed May 31, 2011, entitled "Abnormality Determining Device for Air-Fuel Ratio Sensor". The contents of this application are incorporated herein by reference in their entirety.

BACKGROUND OF THE INVENTION

1. Field of the Invention

The present disclosure relates to an abnormality determining apparatus for an air-fuel ratio sensor.

2. Discussion of the Background

Conventionally, for an abnormality determining device for an air-fuel ratio sensor of this type, there is known such as that disclosed in Japanese Unexamined Patent Application Publication No. 2003-020989, for example. With this abnormality determining device, attention is given to the fact that in the event that the air-fuel ratio sensor is in an abnormal state due to deterioration over time or the like, the output of the air-fuel ratio sensor obtained when restoring fuel supply after ending fuel cutoff operations of an internal combustion engine changes more gradually as compared to a case where there is no abnormality, and accordingly abnormality of the air-fuel ratio sensor is determined as follows. First, the maximum value in the amount of change of the output of the air-fuel ratio sensor obtained from restoration of fuel supply till stabilization of the output of the air-fuel ratio sensor is calculated (hereinafter also referred to as "output change maximum value"). Next, in the event that the calculated output change maximum value is smaller than a predetermined determination reference value, the air-fuel ratio sensor is determined to be in an abnormal state.

SUMMARY OF THE INVENTION

According to one aspect of the present invention, an abnormality determining apparatus includes an air-fuel ratio controller, an output change period parameter calculator, an output change amount extremum calculator, and an abnormality determining device. The air-fuel ratio controller is configured to control an air-fuel mixture air-fuel ratio which is an air-fuel ratio of an air-fuel mixture of an internal combustion engine to be selectively either one of a predetermined lean air-fuel ratio or a predetermined rich air-fuel ratio farther to a rich side as compared to the predetermined lean air-fuel ratio. The output change period parameter calculator is configured to calculate, after the air-fuel ratio controller performs at least one of first switching of the air-fuel mixture air-fuel ratio from the predetermined rich air-fuel ratio to the predetermined lean air-fuel ratio and second switching of the air-fuel mixture air-fuel ratio from the predetermined lean air-fuel ratio to the predetermined rich air-fuel ratio, an output change period parameter representing a period from a timing at which an amount of change of output of an air-fuel ratio sensor reaches a predetermined amount of change to a timing at which the amount of change of output of the air-fuel ratio sensor returns to the predetermined amount of change. The output of the air-fuel ratio sensor is to change due to at least one of the first switching and the second switching. The air-fuel ratio sensor is disposed in an exhaust gas passage of the internal combustion engine to detect an exhaust gas air-fuel ratio which is an air-fuel ratio of exhaust gas from the internal combustion engine. The output change amount extremum calculator is configured to calculate an output change amount extremum obtained within the period represented by the output change period parameter calculated by the output change period parameter calculator. The output change amount extremum includes an extremum of the amount of change of output of the air-fuel ratio sensor. The abnormality determining device is configured to determine an abnormality of the air-fuel ratio sensor based on a relationship between the output change period parameter and the output change amount extremum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
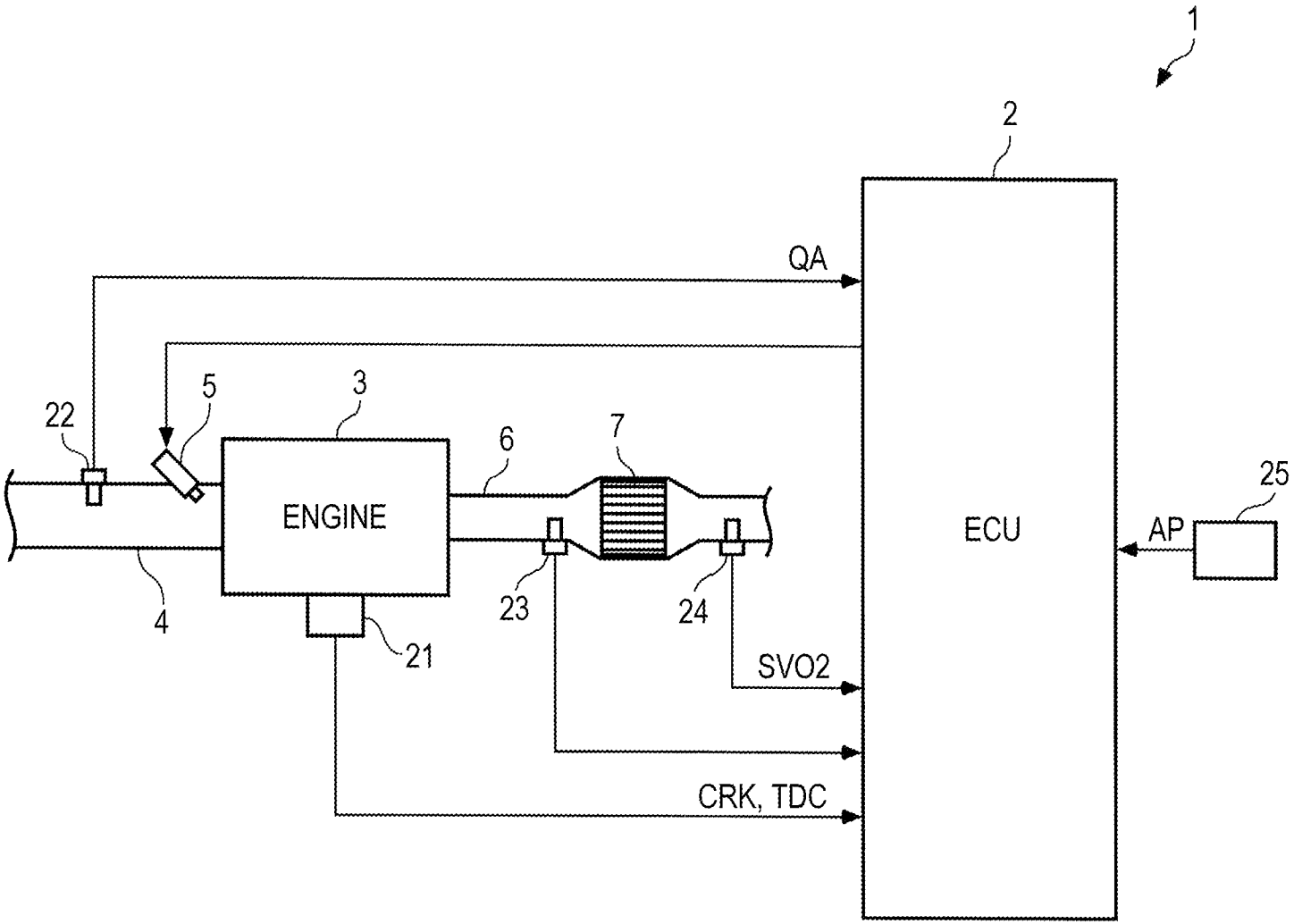
FIG. 1 is a diagram schematically illustrating an abnormality determining device for an air-fuel ratio sensor according to a first embodiment of the present disclosure, along with an internal combustion engine to which it is applied.

The embodiments will now be described with reference to the accompanying drawings, wherein like reference numerals designate corresponding or identical elements throughout the various drawings.

An internal combustion engine (hereinafter referred to as "engine") 3 shown in FIG. 1 is a four-cycle gasoline engine having four cylinders (not illustrated), and is mounted on a vehicle (not illustrated) as a power source. A crankshaft (not illustrated) of the engine 3 is provided with a crank angle sensor 21. The crank angle sensor 21 of the crankshaft outputs CRK signals and TDC signals, which are pulse signals, to a later-described ECU2 of a control device 1.

The CRK signal is output every predetermined crank angle (e.g., 30°). The ECU2 calculates revolutions NE of the engine 3 (hereinafter referred to as "engine revolutions") based on the CRK signals. The TDC signal is a signal indicating that the piston of one of the four cylinders is near the TDC (Top Dead Center) when starting the intake stroke, and with the present example of a four-cylinder type, this is output every 180° of the crank angle. Also, a cylinder distinguishing sensor (not illustrated) is provided to the engine 3, this cylinder distinguishing sensor outputting a cylinder distinguishing signal, which is a pulse signal for distinguishing cylinders, to the ECU2. The ECU2 calculates the crank angle position for each cylinder, based on the cylinder distinguishing signal, CRK signal, and TDC signal.

Provided to an air intake passage 4 of the engine 3 are, in order from the upstream side, an airflow sensor 22 and a fuel injection valve 5. The airflow sensor 22 detects air intake quantity QA taken into each cylinder via the air intake passage 4, and outputs detection signals thereof to the ECU2. A fuel injection valve 5 is provided to each cylinder, so as to face an intake port (only one is illustrated). The valve-opening duration and valve-opening timing of the fuel injection valve 5 are controlled by the ECU2, whereby the fuel injection actions of the fuel injection valve 5 are controlled.

A spark plug (not illustrated) for igniting the air-fuel mixture within the combustion chamber is provided to each cylinder. Sparking operations of the spark plugs are controlled by the ECU2.

Provided to an exhaust passage 6 for discharging exhaust gas from the engine 3 are, in order from the upstream side, an LAF sensor 23, a three-way catalytic converter 7, and an O2 sensor 24. The LAF sensor 23 is configured of zirconia and/or platinum electrodes, linearly detects the air-fuel ratio of exhaust gas (hereinafter also referred to as "exhaust gas air-fuel ratio") over a wide range of air-fuel ratio regions for the air-fuel mixture which has burned at the combustion chamber, from a region richer than a stoichiometric mixture to a leaner region thereof, and also outputs detection signals thereof to the ECU2.

The three-way catalytic converter 7 has oxygen storage capabilities of storing oxygen within the exhaust gas, so as to oxidize HC and CO within the exhaust gas and also reduce NOx, thereby cleaning the exhaust gas. The O2 sensor 24 is configured of zirconia and/or platinum electrodes, and outputs output SVO2 based on the air-fuel ratio of exhaust gas immediately on the downstream side of the three-way catalytic converter 7 (hereinafter referred to as "O2 sensor output") to the ECU2. This O2 sensor output SVO2 goes to a high level in the event that the exhaust gas air-fuel ratio is on the rich side as compared to a stoichiometric exhaust gas air-fuel ratio equivalent to a stoichiometric mixture, goes to a lower level when on the lean side, and rapidly changes around the stoichiometric exhaust gas air-fuel ratio. Thus, the amount of change of the O2 sensor output SVO2 as to the exhaust gas air-fuel ratio is maximum when the exhaust gas air-fuel ratio is near the stoichiometric exhaust gas air-fuel ratio.

The ECU2 further receives a detection signal indicating an accelerator opening angle AP which is the amount of operation of an accelerator pedal (not illustrated) of the vehicle, output from an accelerator opening angle sensor 25.

The ECU2 is configured of a microcomputer made up of a CPU, RAM, ROM, I/O interface (none illustrated), and so forth. The ECU2 follows a control program stored in the ROM to control the engine 3 and determine abnormality of the O2 sensor 24, based on detection signals from the above-described sensors 21 through 25.

Specifically, the ECU2 executes operations to make the air-fuel ratio richer or leaner, in accordance with the calculated engine revolutions NE and demanded torque. When executing such richer operations, the ECU2 controls the air-fuel ratio of the air-fuel mixture (hereinafter also referred to as "air-fuel mixture air-fuel ratio") by way of the fuel injection valve 5 so as to a predetermined rich air-fuel ratio to the rich side of the stoichiometric mixture. Also, during deceleration operations of the engine 3, the ECU2 executes fuel cutoff operations where supply of fuel to the engine 3 is stopped. Further, the ECU2 performs a CAT (catalytic) reduction mode upon the fuel cutoff operation ending. This CAT reduction mode is an operating mode in which the air-fuel mixture air-fuel ratio us controlled to a rich air-fuel ratio, such that the oxygen stored in the three-way catalytic converter 7 due to execution of the fuel cutoff operation is discharged to perform reduction, and us performed for a relatively long time (e.g., 10 seconds) after the fuel cutoff operation has ended.

Figure 2:
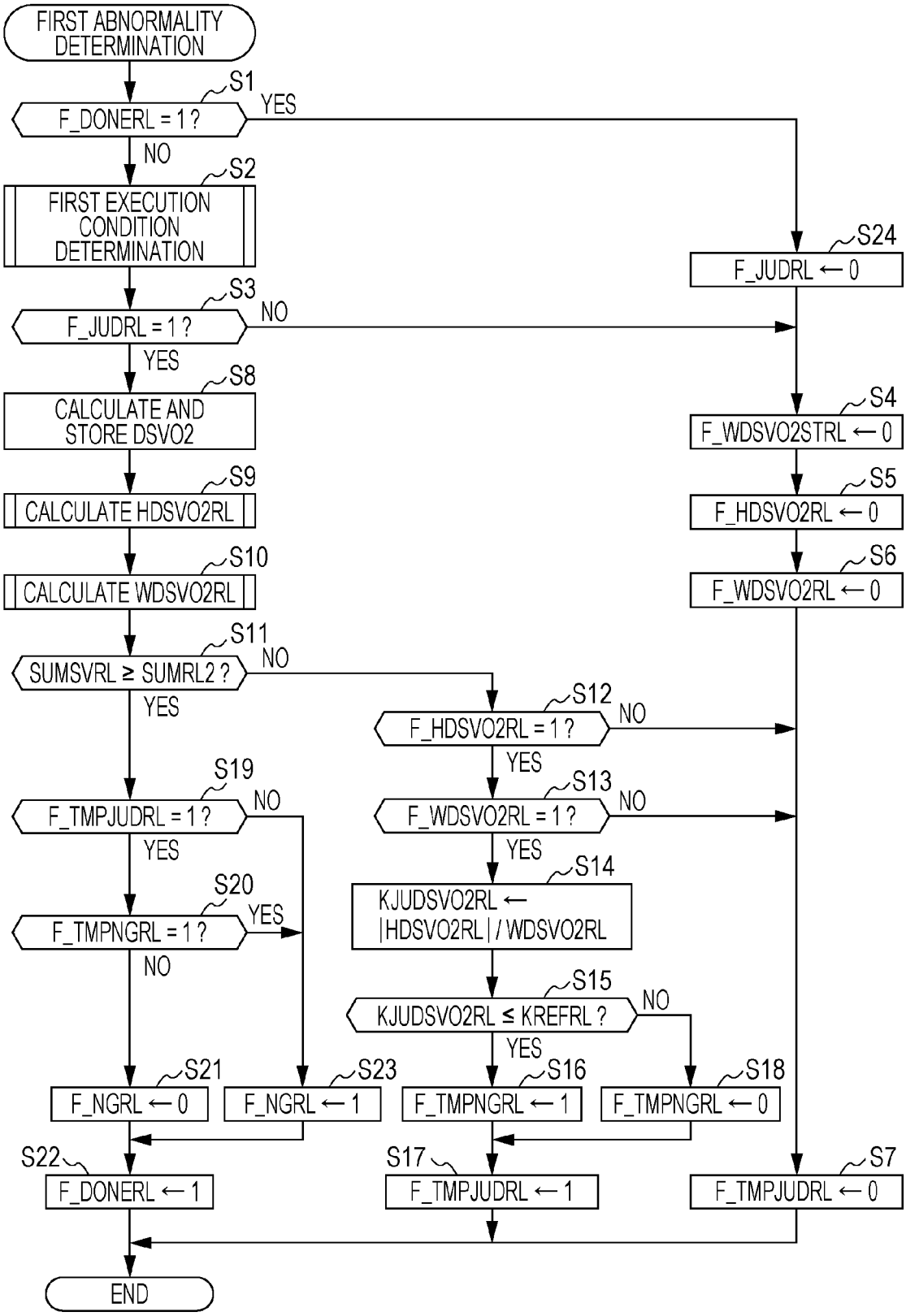
FIG. 2 is a flowchart illustrating a main routine of first abnormality determination processing according to the first embodiment.

Also, the ECU2 executes first abnormality determination processing shown in FIG. 2. With this first abnormality determination processing, determination is made of an abnormality in response properties of the O2 sensor 24 when switching the air-fuel mixture air-fuel ratio from the above-described rich air-fuel ratio to a lean air-fuel ratio on the leaner side from the stoichiometric mixture. Switching of the operating mode of the engine 3 from enriching operations to fuel cutoff operations is used as the switching of the air-fuel mixture air-fuel ratio from the rich air-fuel ratio to the lean air-fuel ratio in this case. Also, this processing is repeatedly performed in predetermined cycles (e.g., predetermined cycles within a range of 10 to 50 milliseconds) after starting the engine 3, which are continued until the engine 3 is turned off.

First, in step 1 in FIG. 2 (written as "S1", the same hereinafter), determination is made regarding whether or not a first abnormality determination completion flag F_DONERL is "1". This first abnormality determination completion flag F_DONERL is set to "1" upon abnormality determination according to the current cycle (first abnormality determination processing) being completed, and is reset to "0" when starting the engine 3.

In the event that the result of step S1 is NO, meaning that the abnormality determination processing according to the current cycle has not been completed yet, the flow volume advances to step S2, where first execution conditions determination processing is executed. This first execution condition determination processing is for determining whether or not a first execution condition, which is a condition for executing abnormality determination according to the first abnormality determination processing, holds, and is executed following the flowchart shown in FIG. 3.

Figure 3:
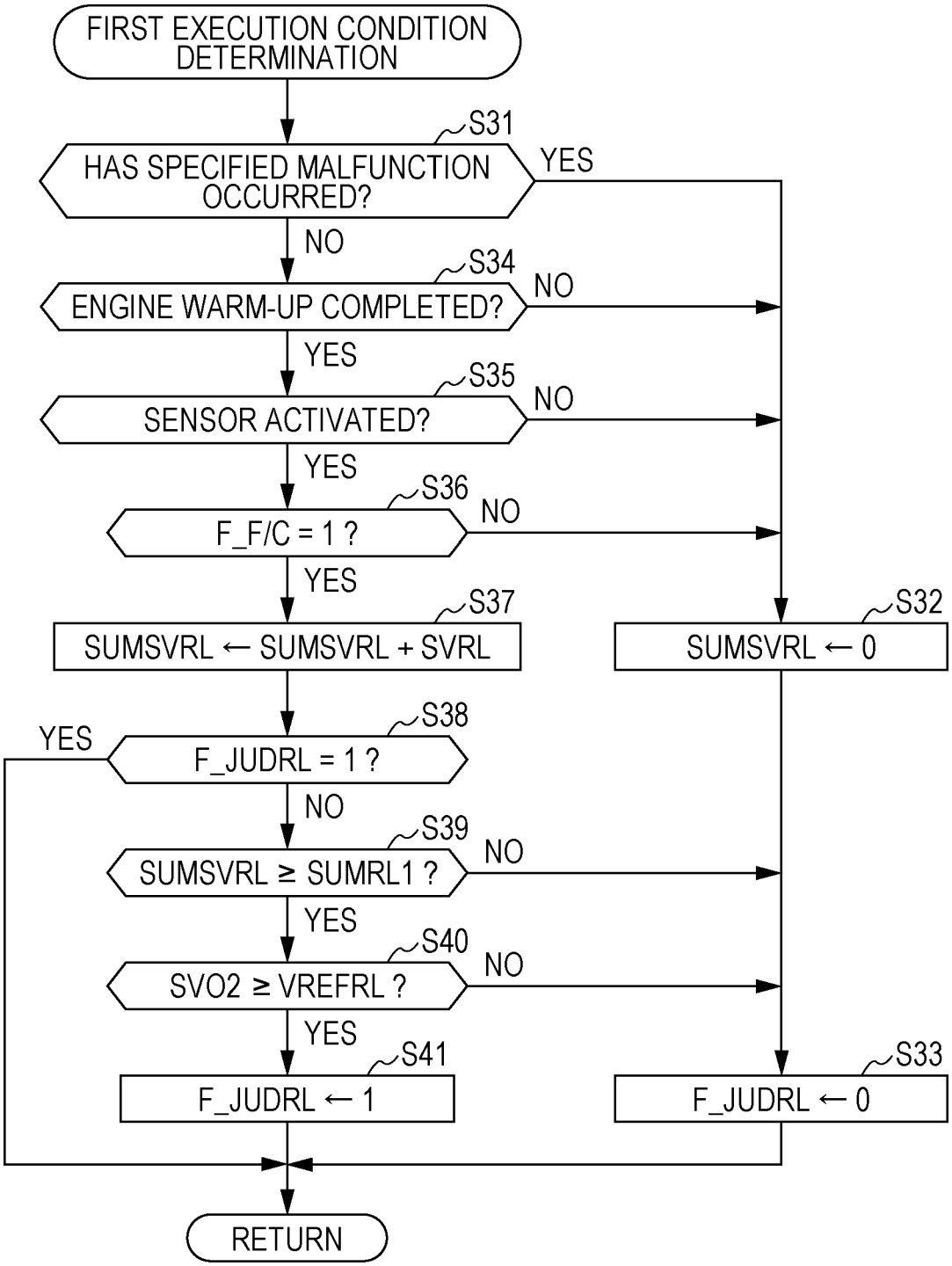
FIG. 3 is a flowchart illustrating a subroutine of first execution condition determination processing executed in the first abnormality determination processing in FIG. 2.

First, in step S31 in FIG. 3, determination is made regarding whether or not a specified malfunction has occurred. Determination is made that a specified malfunction has occurred when any of the following conditions (a) through (c) hold, for example.

(a) Determination is made by fuel system malfunction determination processing (not illustrated) that there is a malfunction in the fuel supply system such as the fuel injection valve 5.

(b) Determination is made by ignition system malfunction determination processing (not illustrated) that there is a malfunction in the spark plugs.

(c) Determination is made by sensor malfunction determination processing that various types of sensors other than the O2 sensor 24 are malfunctioning.

In the event that the result of step S31 is YES, meaning that the fuel injection valve 5 or the like is malfunctioning, in step S32 a later-described first exhaust gas flow volume accumulation value SUMSVRL is reset to a value "0". Next, in step S33 a first execution condition satisfaction flag F_JUDRL is set to "0", representing that the first execution condition has been deemed to be unsatisfied since abnormality of the O2 sensor 24 cannot be accurately determined due to malfunctioning of the fuel injection valve 5 or the like, and the current cycle ends.

On the other hand, in the event that the result of step S31 is NO, determination is made in step S34 regarding whether or not warm-up of the engine 3 has been completed. This determination is made based on the temperature of the coolant of the engine 3, detected by sensors or the like. In the event that the result of step S34 so NO, meaning that warm-up of the engine 3 is not complete, the above-described step S32 is executed, and the above-described step S33 is executed since abnormality of the O2 sensor 24 may not be accurately determined due to the operating state of the engine 3 unstable, and the current cycle ends.

On the other hand, in the event that the result of step S34 is YES, determination is made in step S35 regarding whether or not the O2 sensor 24 has been activated. Determination is made that the O2 sensor 24 has been activated in the event that the O2 sensor output SVO2 exceeds a predetermined value. In the event that the result of step S35 is NO, meaning that the O2 sensor 24 has not been activated, the above-described step S33 is executed since the first execution condition does not hold, as abnormality of the O2 sensor 24 may not be accurately determined due to this, and the current cycle ends.

On the other hand, in the event that the result of step S35 is YES, determination is made in step S36 regarding whether or not a fuel cutoff flag F_F/C is "1". This fuel cutoff flag F_F/C is set to "1" when the operating mode of the engine 3 has switched from the above-described enriching operation to fuel cutoff operation, and is thereafter held at "1" while this fuel cutoff operation is being executed. In the event that the result of step S36 is NO, steps S32 and S33 are executed, deeming the first execution condition to be unsatisfied, and the current cycle ends.

The reason why the first execution condition is deemed to be unsatisfied unless during fuel cutoff operation after enriching operation is that, as described above, with the first abnormality determination processing, determination is made of an abnormality in response properties of the O2 sensor 24 when switching the air-fuel mixture air-fuel ratio from the rich air-fuel ratio to a lean air-fuel ratio, and switching of the operating mode of the engine 3 from enriching operations to fuel cutoff operations is used as the switching of the air-fuel mixture air-fuel ratio in this case.

On the other hand, in the event that the result of step S36 is YES, in step S37 a current value for the first exhaust gas flow volume accumulation value SUMSVRL is calculated by adding a first exhaust gas flow volume value SVRL to the previous value for the first exhaust gas flow volume accumulation value SUMSVRL obtained so far. This first exhaust gas flow volume value SVRL is equivalent to the flow volume of exhaust gas emitted from the engine 3 in the current cycle, and is calculated in accordance with the intake air quantity QA that has been detected. Also, the first exhaust gas flow volume accumulation value SUMSVRL is equivalent to the accumulated value of the exhaust gas flow volume emitted from starting of the fuel cutoff operation up to now. The reason is as follows.

That is, the determination results of the steps S31, S34, and S35 are obtained before the first fuel cutoff operation is performed after starting the engine 3. Additionally, unless the result of step S36 is YES, i.e., unless fuel cutoff operation is executed, the first exhaust gas flow volume accumulation value SUMSVRL is held at the value "0" by executing step S32, and also the first exhaust gas flow volume accumulation value SUMSVRL is calculated by adding the flow volume of exhaust gas (first exhaust gas flow volume value SVRL) emitted from the engine 3 in the current processing cycle to the previous value.

In step S38 following the above step S37, determination is made regarding whether or not the first execution condition satisfaction flag F_JUDRL is "1". In the event that the result is NO (F_JUDRL=0), determination is made in step S39 regarding whether or not the first exhaust gas flow volume accumulation value SUMSVRL calculated in step S37 above is equal to or greater than a first predetermined value SUMRL1.

In the event that the result of step S39 above is NO (SUMSVRL<SUMRL1), and the accumulated value of exhaust gas flow volume from the time of starting fuel cutoff operation is smaller than the first predetermined value SUMRL1, the exhaust gas corresponding to the air-fuel mixture air-fuel ratio switched from the rich air-fuel ratio to the lean air-fuel ratio by starting the fuel cutoff operation is deemed to have not reached the O2 sensor 24 yet. Also, the first execution condition is determined to be unsatisfied since abnormality of the O2 sensor 24 may not be accurately determined due to this, so step S33 is executed, and the current cycle ends.

On the other hand, in the event that the result of step S39 above is YES (SUMSVRL≥SUMRL1), and the accumulated value of exhaust gas flow volume from the time of starting fuel cutoff operation has reached the first predetermined value SUMRL1, determination is made in step S40 regarding whether or not the O2 sensor output SVO2 is equal to or greater than a first predetermined output VREFRL.

In the event that the result of step S40 above is NO (SVO2<VREFRL), the exhaust gas air-fuel ratio represented by the O2 sensor output SVO2 is at the lean side, and the first execution condition is determined to be unsatisfied since abnormality of the O2 sensor 24 may not be accurately determined at the time of switching the air-fuel mixture air-fuel ratio from the rich air-fuel ratio to the lean air-fuel ratio, so step S33 is executed, and the current cycle ends.

On the other hand, in the event that the result of step S40 is YES, and the O2 sensor output SVO2 is equal to or greater than the first predetermined output VREFRL, the first execution condition is determined to be satisfied, the first execution condition satisfaction flag F_JUDRL is set to "1" in step S41, and the current cycle ends. Also, in the event that the result of the above step S38 is YES (F_JUDRL=1), the current cycle ends at that point.

Returning to FIG. 2, in step S3 following the above-described step S2, determination is made regarding whether or not the first execution condition satisfaction flag F_JUDRL is "1". In the event that the result thereof is NO (F_JUDRL=0), and the first executing condition is not satisfied, the later-described first start-point exhaust gas flow volume accumulation value calculation-completed flag F_WDSVO2STRL, first output change amount extremum calculation-completed flag F_HDSVO2RL, first output change period parameter calculation-completed flag F_WDSVO2RL, and first temporary determination-completed flag F_TMPJUDRL are each reset to "0" in steps S4 through S7 respectively, and the current cycle ends.

On the other hand, in the event that the result of step S3 above is YES (F_JUDRL=1), and the first execution condition is satisfied, in step S8 the output change amount DSVO2 obtained at this point is shifted to the previous value DSVO2Z, and also the current value for the output change amount DSVO2 is calculated. This output change amount DSVO2 is calculated by subtracting the O2 sensor output SVO2 (previous value) detected in the previous processing cycle from the O2 sensor output SVO2 (current value) detected in the current processing cycle.

Figure 4:
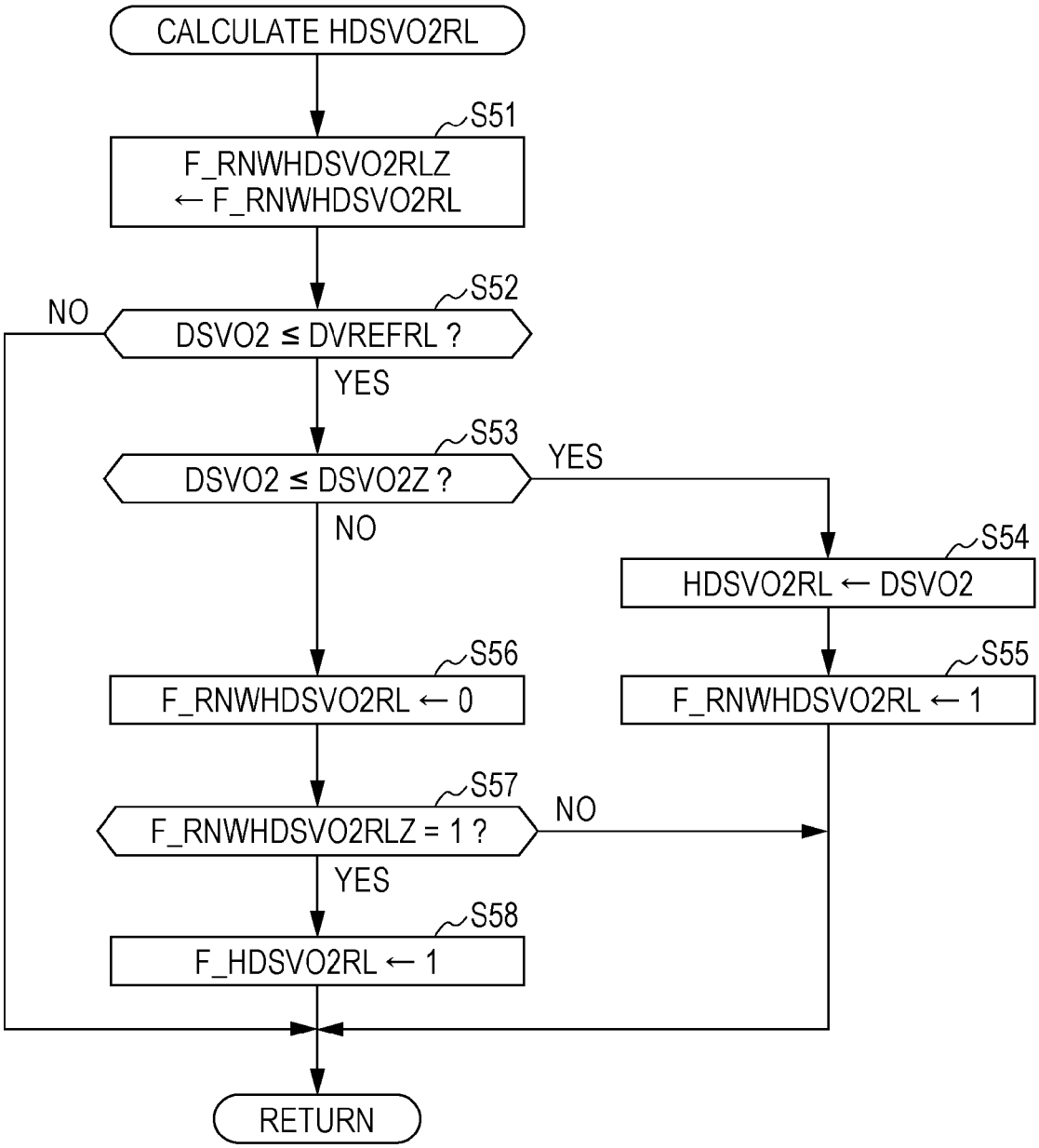
FIG. 4 is a flowchart illustrating a subroutine of HDSVO2RL calculation processing executed in the first abnormality determination processing in FIG. 2.
Figure 5:
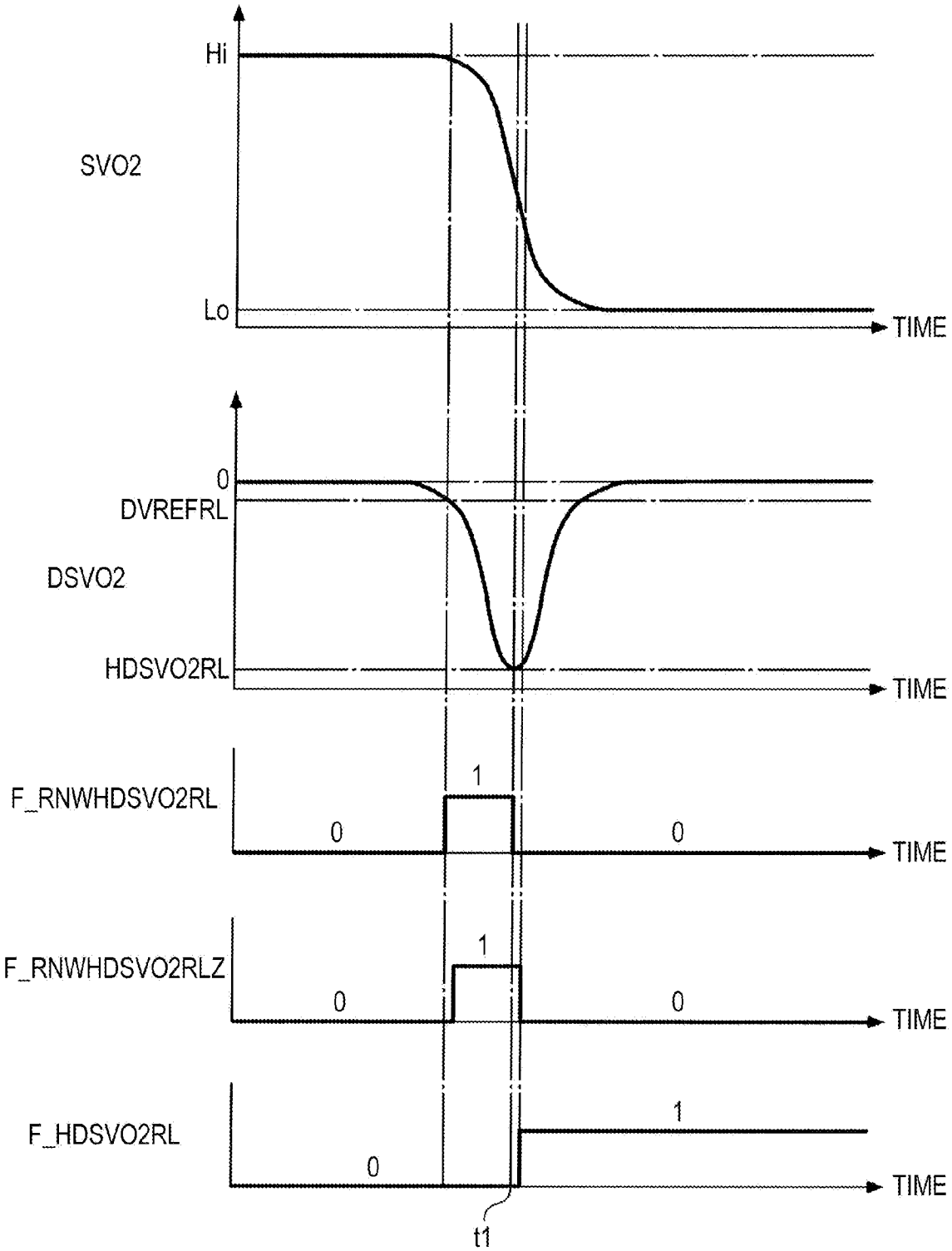
FIG. 5 is a diagram illustrating an operation example of the HDSVO2RL calculation processing in FIG. 4.

In step S9 following step S8, HDSVO2RL calculation processing shown in FIG. 4 is executed. As described above, with the first abnormality determination processing including the current cycle, determination is made of an abnormality in response properties of the O2 sensor 24 when switching the air-fuel mixture air-fuel ratio from the rich air-fuel ratio to the lean air-fuel ratio. In this case, as shown in FIG. 5, the O2 sensor output SVO2 changes from high level to low level by switching of the air-fuel mixture air-fuel ratio, and accordingly the output change amount DSVO2 which is the amount of change of the O2 sensor output SVO2 goes from the value "0" to a negative value, whereby the absolute value thereof increases, and following reaching the extremum the absolute value thereof decreases and returns to the value "0". With the current cycle, a first output change amount extremum HDSVO2RL is calculated as the extremum of the output change amount DSVO2 within the period from the output change amount DSVO2 reaching a later-described first predetermined change amount DVREFRL until returning to the first predetermined change amount DVREFRL.

First, in step S51 in FIG. 4, a first output change amount increasing flag F_RNWHDSVO2RL is shifted to the previous value F_RNWHDSVO2RLZ. Details of this first output change amount increasing flag F_RNWHDSVO2RL will be described later.

Next, determination is made in step S52 regarding whether or not the output change amount DSVO2 calculated in step S8 in FIG. 2 is equal to or below the first predetermined change amount DVREFRL. This first predetermined change amount DVREFRL is set to a predetermined negative value such that determination can be made in a sure manner whether or not the output change amount DSVO2 is changing (see FIG. 5). In the event that the result of step S52 is NO, the current cycle ends at this point. On the other hand, in the event that the result of step S52 is YES, meaning that the output change amount DSVO2 is equal to or below the first predetermined change amount DVREFRL, determination is made in step S53 regarding whether or not the current value of output change amount DSVO2 is equal to or lower than the previous value DSVO2Z thereof.

In the event that the result of step S53 is YES and DSVO2≤DSVO2Z, i.e., the negative output change amount DSVO2 (absolute value) is increasing, the output change amount DSVO2 is set for the first output change amount extremum HDSVO2RL in step S54, the first output change amount increasing flag F_RNWHDSVO2RL is set to "1" in step S55 to indicate that the output change amount DSVO2 (absolute value) is increasing, and the current cycle ends. Note that the first output change amount increasing flag F_RNWHDSVO2RL is reset to "0" when starting the engine 3.

On the other hand, in the event that the result of step S53 is NO and the current value of output change amount DSVO2 is greater than the previous value DSVO2Z, the first output change amount increasing flag F_RNWHDSVO2RL is set to "0" in step S56 since the output change amount DSVO2 (absolute value) is changing to in the direction of decreasing. Next, determination is made in step S57 regarding whether or not the previous value of the first output change amount increasing flag F_RNWHDSVO2RLZ set in step S51 is "1".

In the event that the result of step S57 is YES (F_RNWHDSVO2RLZ=1), this means that calculation (setting) of the first output change amount extremum HDSVO2RL has been completed by execution of step S54 in the previous processing cycle, so in order to represent this, the first output change amount extremum calculation-completed flag F_HDSVO2RL is set to "1" in step S58, and the current cycle ends. On the other hand, in the event that the result of step S57 is NO, i.e., in the event that output change amount DSVO2 is decreasing, the current cycle ends at that point.

The reason why the first output change amount extremum HDSVO2RL is thus calculated is due to the following reason. As long as the output change amount DSVO2 is smaller than the previous value DSVO2Z thereof (YES in step S53), i.e., as long as the output change amount DSVO2 continues to increase, the first output change amount extremum HDSVO2RL is updated by the current output change amount DSVO2 due to the execution in step S54. Also, when the output change amount DSVO2 (absolute value) which had been changing in the direction of increasing so far begins to change in the direction of decreasing (point-in-time t1 in FIG. 5), the first output change amount increasing flag F_RNWHDSVO2RL accordingly is set to "0" in step S56.

At this point-in-time t1, the previous value F_RNWHDSVO2RLZ of the first output change amount increasing flag is "1", and consequently, the result of step S57 is YES. As can be clearly understood from this, the output change amount DSVO2 obtained in the processing cycle immediately preceding the result of step S57 becoming YES is equivalent to the extremum thereof, and at the point that the result of step S57 becomes YES, the calculation (setting) of the first output change amount extremum HDSVO2RL in step S54 is completed; this is the reason. Note that as shown in FIG. 5, after reaching the extremum the output change amount DSVO2 returns to the first predetermined change amount DVREFRL and becomes greater than the first predetermined change amount DVREFRL (NO in step S52). As described above, the first output change amount extremum HDSVO2RL is the extremum of the output change amount DSVO2 obtained within the period from the output change amount DSVO2 becoming the first predetermined change amount DVREFRL until returning to the first predetermined change amount DVREFRL again.

Figure 6:
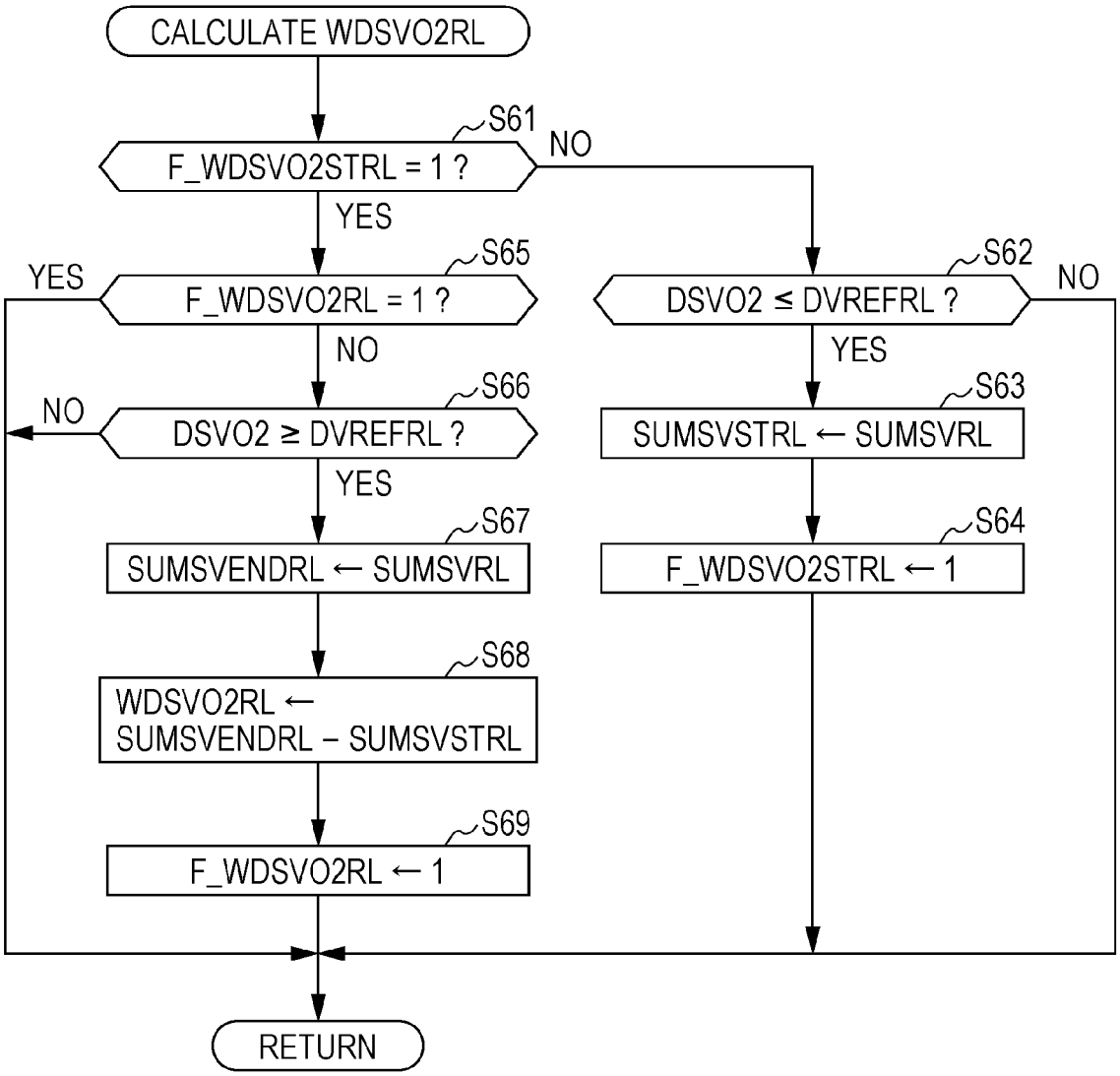
FIG. 6 is a flowchart illustrating a subroutine of WDSVO2RL calculation processing executed in the first abnormality determination processing in FIG. 2.

Returning to FIG. 2, in step S10 following the above step S9, WDSVO2RL calculation processing shown in FIG. 6 is performed. With the current cycle, a first output change period parameter WDSVO2RL which represents the period from the output change amount DSVO2 becoming the first predetermined change amount DVREFRL up to returning to the first predetermined change amount DVREFRL again is calculated (see FIG. 7).

In step S61 in FIG. 6, determination is made regarding whether or not the first start-point exhaust gas flow volume accumulation value calculation-completed flag F_WDSVO2STRL is "1". This first start-point exhaust gas flow volume accumulation value calculation-completed flag F_WDSVO2STRL is set to "1" when calculation of a later-described first start-point exhaust gas flow volume accumulation value SUMSVSTRL is completed, and is reset to "0" when starting the engine 3.

In the event that the result of step S61 is NO (F_WDSVO2STRL=0), and calculation of the first start-point exhaust gas flow volume accumulation value SUMSVSTRL is not completed, determination is made in step S62 regarding whether or not the output change amount DSVO2 is equal to or below the first predetermined change amount DVREFRL. In the event that the response thereto is NO, the current cycle ends at that point.

On the other hand, in the event that the result of step S62 is YES and the output change amount DSVO2 is equal to or below the first predetermined change amount DVREFRL, the first exhaust gas flow volume accumulation value SUMSVRL calculated in step S37 in FIG. 3 is set as the first start-point exhaust gas flow volume accumulation value SUMSVSTRL in step S63. Next, to represent that calculation (setting) of the first start-point exhaust gas flow volume accumulation value SUMSVSTRL has been completed, the first start-point exhaust gas flow volume accumulation value calculation-completed flag F_WDSVO2STRL is set to "1" in step S64, and the current cycle ends.

Figure 7:
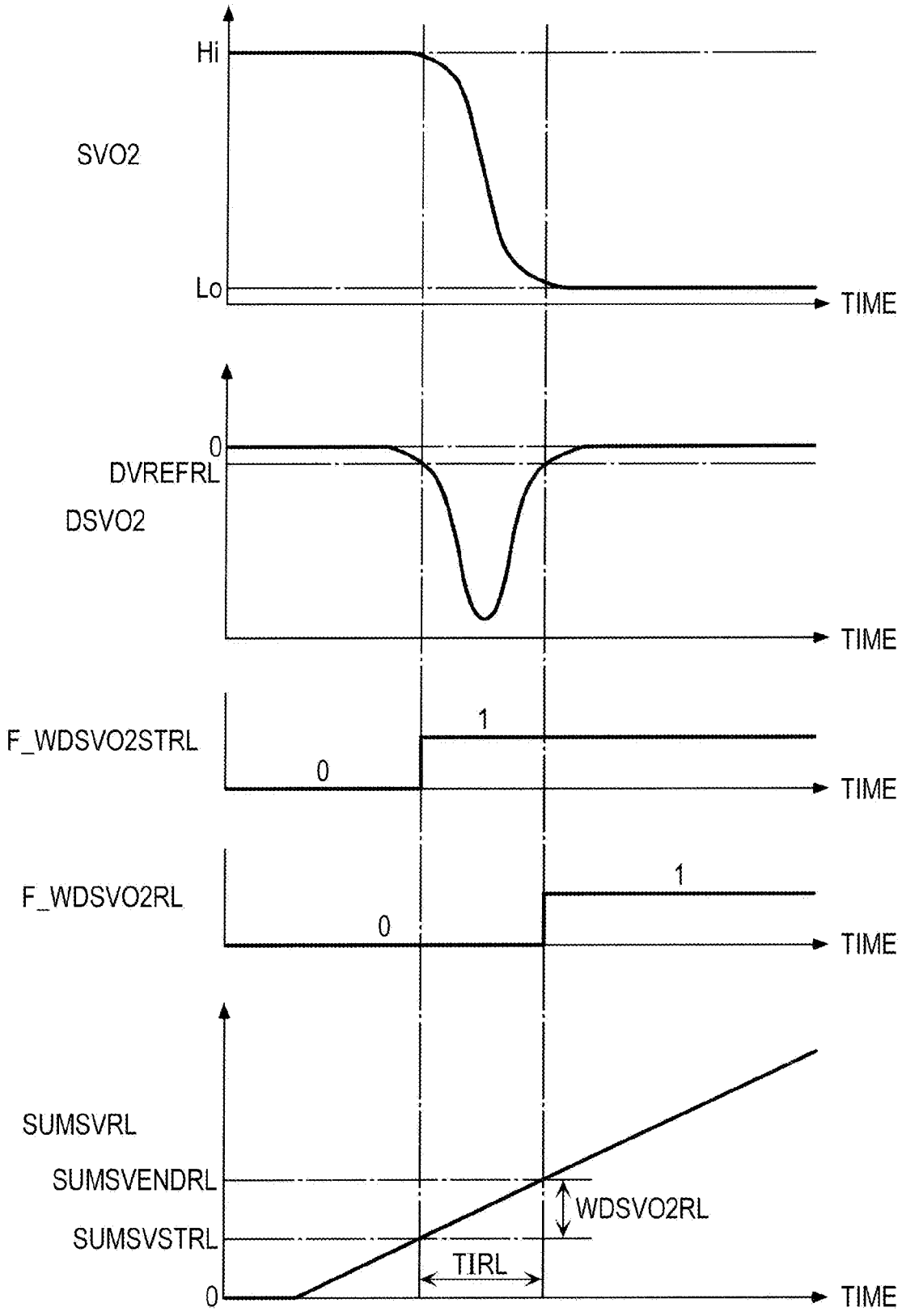
FIG. 7 is a diagram illustrating an operation example of the WDSVO2RL calculation processing in FIG. 6.

As can be clearly understood from the calculation method thereof, the first start-point exhaust gas flow volume accumulation value SUMSVSTRL is equivalent to the accumulation value of the exhaust gas flow volume from starting of fuel cutoff operation until the output change amount DSVO2 reaches the first predetermined change amount DVREFRL (see FIG. 7).

On the other hand, in the event that the result of step S61 is YES (F_WDSVO2STRL=1), determination is made in step S65 regarding whether the first output change period parameter calculation-completed flag F_WDSVO2RL is "1". This first output change period parameter calculation-completed flag F_WDSVO2RL is set to "1" when calculation of the first output change period parameter WDSVO2RL has been completed.

In the event that the result of this step S65 is NO (F_WDSVO2RL=0), and calculation of the first output change period parameter WDSVO2RL has not been completed, determination is made in step S66 regarding whether or not the output change amount DSVO2 is equal to or greater than the first predetermined change amount DVREFRL. In the event that the result thereof is NO, the current cycle ends at that point.

On the other hand, in the event that the result of step S66 is YES and the output change amount DSVO2 is equal to the first predetermined change amount DVREFRL, the first exhaust gas flow volume accumulation value SUMSVRL is set in step S67 as a first end-point exhaust gas flow volume accumulation value SUMSVENDRL. As can be clearly understood from the calculation method thereof, the first end-point exhaust gas flow volume accumulation value SUMSVENDRL is equivalent to the accumulation value of exhaust gas flow volume from starting of fuel cutoff operation until the output change amount DSVO2 returns to the first predetermined change amount DVREFRL again (see FIG. 7).

Next, in step S68, the first start-point exhaust gas flow volume accumulation value SUMSVSTRL set in step S63 is subtracted from the first end-point exhaust gas flow volume accumulation value SUMSVENDRL set in step S67 above, thereby calculating the first output change period parameter WDSVO2RL. Next, to represent that calculation of the first output change period parameter WDSVO2RL has been completed, in step S69 the first output change period parameter calculation-completed flag F_WDSVO2RL is set to "1", and the current cycle ends.

Also, in the event that the result of step S65 is YES (F_WDSVO2RL=1), the current cycle ends at that point.

As described above, the first start-point exhaust gas flow volume accumulation value SUMSVSTRL is equivalent to the accumulation value of the exhaust gas flow volume from starting of fuel cutoff operation until the output change amount DSVO2 reaches the first predetermined change amount DVREFRL, and the first end-point exhaust gas flow volume accumulation value SUMSVENDRL is equivalent to the accumulation value of the exhaust gas flow volume from starting of fuel cutoff operation until the output change amount DSVO2 returns to the first predetermined change amount DVREFRL again. Accordingly, as shown in FIG. 7, the first output change period parameter WDSVO2RL calculated by subtracting the former (SUMSVSTRL) from the latter (SUMSVENDRL) is equivalent to the accumulation value of the exhaust gas flow volume from the output change amount DSVO2 becoming the first predetermined change amount DVREFRL until returning to the first predetermined change amount DVREFRL again, and suitably expresses the period from the output change amount DSVO2 becoming the first predetermined change amount DVREFRL until returning to the first predetermined change amount DVREFRL again (indicated by TIRL in FIG. 7).

Returning to FIG. 2, in the following step S11 following step S10, determination is made regarding whether or not the first exhaust gas flow volume accumulation value SUMSVRL is equal to or above a second predetermined value SUMRL2. In the event that the result thereof is NO (SUMSVRL<SUMRL2), determination is made in step S12 regarding whether or not the first output change amount extremum calculation-completed flag F_HDSVO2RL set in step S58 in FIG. 4 is "1". In the event that the result thereof is No, and the first output change amount extremum HDSVO2RL has not been calculated, the flow goes to the above-described step S7, and the current cycle ends.

On the other hand, in the event that the result of step S12 is YES and the first output change amount extremum HDSVO2RL has been calculated, determination is made in step S13 regarding whether or not the first output change period parameter calculation-completed flag F_WDSVO2RL set in step S69 in FIG. 6 is "1". In the event that the result thereof is NO and the first output change period parameter WDSVO2RL has not been calculated, the flow goes to step S7, and the current cycle ends.

On the other hand, in the event that the result of step S13 described above is YES, i.e., both the first output change amount extremum HDSVO2RL and first output change period parameter WDSVO2RL have been calculated, a ratio of the first output change amount extremum absolute value |HDSVO2RL| set in step S54 in FIG. 4 as to the first output change period parameter WDSVO2RL calculated in step S68 in FIG. 6 (i.e., |HDSVO2RL|/WDSVO2RL) is calculated in step S14 as a first determining parameter KJUDSVO2RL. Next, determination is made in step S15 regarding whether or not the calculated first determining parameter KJUDSVO2RL is equal to or below a first determining value KREFRL.

In the event that the result thereof is YES, and the first determining parameter KJUDSVO2RL is equal to or below the first determining value KREFRL, temporary determination is made that an abnormality is occurring in the response properties of the O2 sensor 24 at the time of switching the air-fuel ratio to the lean air-fuel ratio (hereinafter referred to as "first abnormality"), and in step S16 sets a first temporary abnormality flag F_TMPNGRL to "1" to represent this. Next, the first temporary determination-completed flag F_TMPJUDRL is set to "1" in step S17 to represent that temporary determination results have been obtained for the first abnormality, and the current cycle ends.

On the other hand, in the event that the result in step S15 described above is NO, and the first determining parameter KJUDSVO2RL is greater than the first determining value KREFRL, temporary determination is made that the first abnormality is not occurring, and in step S18 the first temporary abnormality flag F_TMPNGRL is set to "0" to represent this. Subsequently, the above-described step S17 is executed, and the current cycle ends.

The reason why temporary determination is made for the first abnormality of the O2 sensor 24 as described above is that, as described earlier with reference to FIGS. 19A through 20B, when there is an abnormality at the O2 sensor 24 the first output change amount extremum absolute value |HDSVO2RL| becomes smaller and the first output change period parameter WDSVO2RL becomes greater, resulting in the ratio of the first output change amount extremum absolute value |HDSVO2RL| as to the first determining parameter KJUDSVO2RL, i.e., first output change period parameter WDSVO2RL, dropping to or below the first determining value KREFRL.

Note that once a temporary determination is obtained for the first abnormality in steps S15, S16, and S18, even if the first output change amount extremum HDSVO2RL is calculated again thereafter in a subsequent cycle before YES is obtained in step S1, steps S12 through S18 are not executed, and the results of the temporary determination of the first abnormality are not changed. Accordingly, with the current cycle, in the event that multiple first output change amount extremums HDSVO2RL are calculated as described later with a second embodiment, temporary determination of the first abnormality of the O2 sensor 24 is made based on the relationship between the earliest first output change amount extremum HDSVO2RL and the first output change period parameter WDSVO2RL corresponding thereto.

On the other hand, in the event that the result in step S11 is YES and the first exhaust gas flow volume accumulation value SUMSVRL has reached a second predetermined value SUMRL2, i.e., a great amount of exhaust gas has passed over the O2 sensor 24 after starting switching of the air-fuel mixture air-fuel ratio to the lean air-fuel ratio, determination is made in step S19 regarding whether or not the first temporary determination-completed flag F_TMPJUDRL set in step S7 or S17 in a previous cycle is "1". In the event that the result is YES and a temporary determination result has been obtained for the first abnormality, determination is made in step S20 regarding whether or not the first temporary abnormality flag F_TMPNGRL is "1".

In the event that the result thereof is NO (F_TMPNGRL=0), i.e., that a great amount of exhaust gas has passed over the O2 sensor 24 after starting switching of the air-fuel mixture air-fuel ratio to the lean air-fuel ratio and also non-occurrence of the first abnormality of the O2 sensor 24 is temporarily determined, the determination that the first abnormality has not occurred is finalized, and a first abnormality flag F_NGRL is set to "0" in step S21 to represent this. Next, the first abnormality determination completion flag F_DONERL is set to "1" in step S22 to represent that abnormality determination according to the current cycle has been completed, and the current cycle ends.

On the other hand, in the event that the result of step S20 is YES (F_TMPNGRL=1), i.e., that a great amount of exhaust gas has passed over the O2 sensor 24 after starting switching of the air-fuel mixture air-fuel ratio to the lean air-fuel ratio and also occurrence of the first abnormality of the O2 sensor 24 has been temporarily determined, the determination that the first abnormality has occurred is finalized, and the first abnormality flag F_NGRL is set to "1" in step S23 to represent this. Next, the above-described step S22 is executed, and the current cycle ends.

On the other hand, in the event that the result of step S19 is NO and the first temporary determination-completed flag F_TMPJUDRL is "0", i.e., that a great amount of gas has passed over the O2 sensor 24 after starting switching of the air-fuel mixture air-fuel ratio to the lean air-fuel ratio but temporary determination results of the first abnormality are not obtained since calculation of the first output change amount extremum HDSVO2RL and/or first output change period parameter WDSVO2RL has not been performed, determination that the first abnormality has occurred is finalized, the above-described steps S23 and S22 are executed, and the current cycle ends.

Also, in the event that executing step S22 in a previous cycle results in the result of the above-described step S1 being YES (F_DONERL=1), the first execution condition satisfaction flag F_JUDRL is reset to "0" in step S24, the steps S4 through S7 are executed, and the current cycle ends.

Next, second abnormality determination processing will be described with reference to FIGS. 8 through 11. With this second abnormality determination processing, abnormality in response properties of the O2 sensor 24 at the time of switching the air-fuel mixture air-fuel ratio from the lean air-fuel ratio to the rich air-fuel ratio are determined based on the relation between the period of change of the output change amount DSVO2 and the extremum during this period of change, in the same way as with the first abnormality determination processing. For the switching of the air-fuel mixture air-fuel ratio to the rich air-fuel ratio in this case, switching of the operation mode of the engine 3 from fuel cutoff operation to the above-described CAT reduction mode is used. Note that the second abnormality determination processing is repeatedly performed in predetermined cycles (e.g., predetermined cycles within a range of 10 to 50 milliseconds) after starting the engine 3, in the same way as with the first abnormality determination processing.

Figure 8:
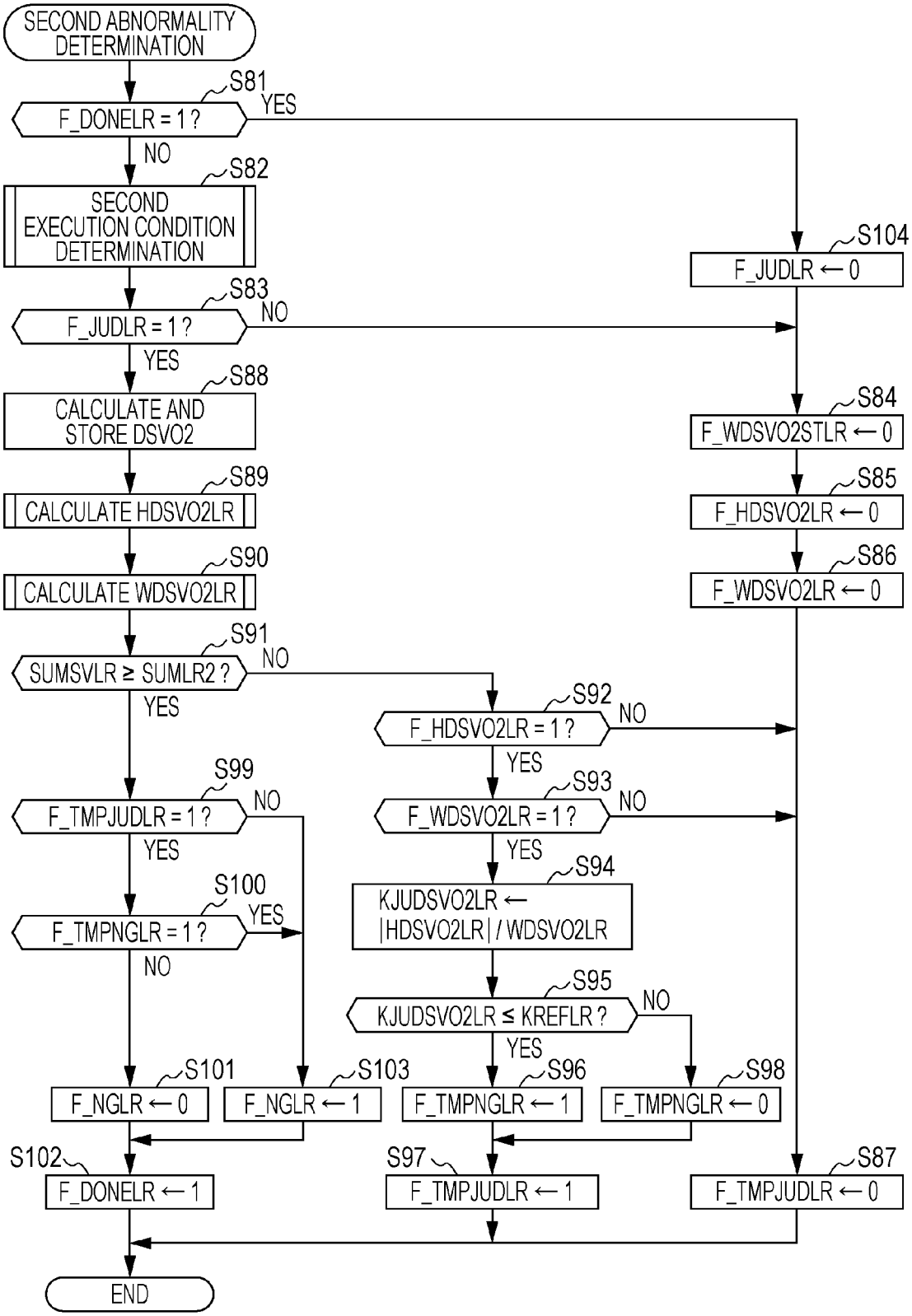
FIG. 8 is a flowchart illustrating a main routine of second abnormality determination processing according to the first embodiment.

In step S81 in FIG. 8, determination is made regarding whether or not a second abnormality determination completion flag F_DONELR is "1". This second abnormality determination completion flag F_DONELR is set to "1" in the event that abnormality determination processing according to the current cycle (second abnormality determination processing) is completed, and is reset to "0" when starting the engine 3.

In the event that the result of step S81 is NO and abnormality determination by the present process has not been completed, second execution condition determination processing is executed in step S82. This second execution condition determination processing is for determining whether or not a second execution condition, which is a condition for executing abnormality determination according to the second abnormality determination processing, holds, and is executed following the flowchart shown in FIG. 9.

Figure 9:
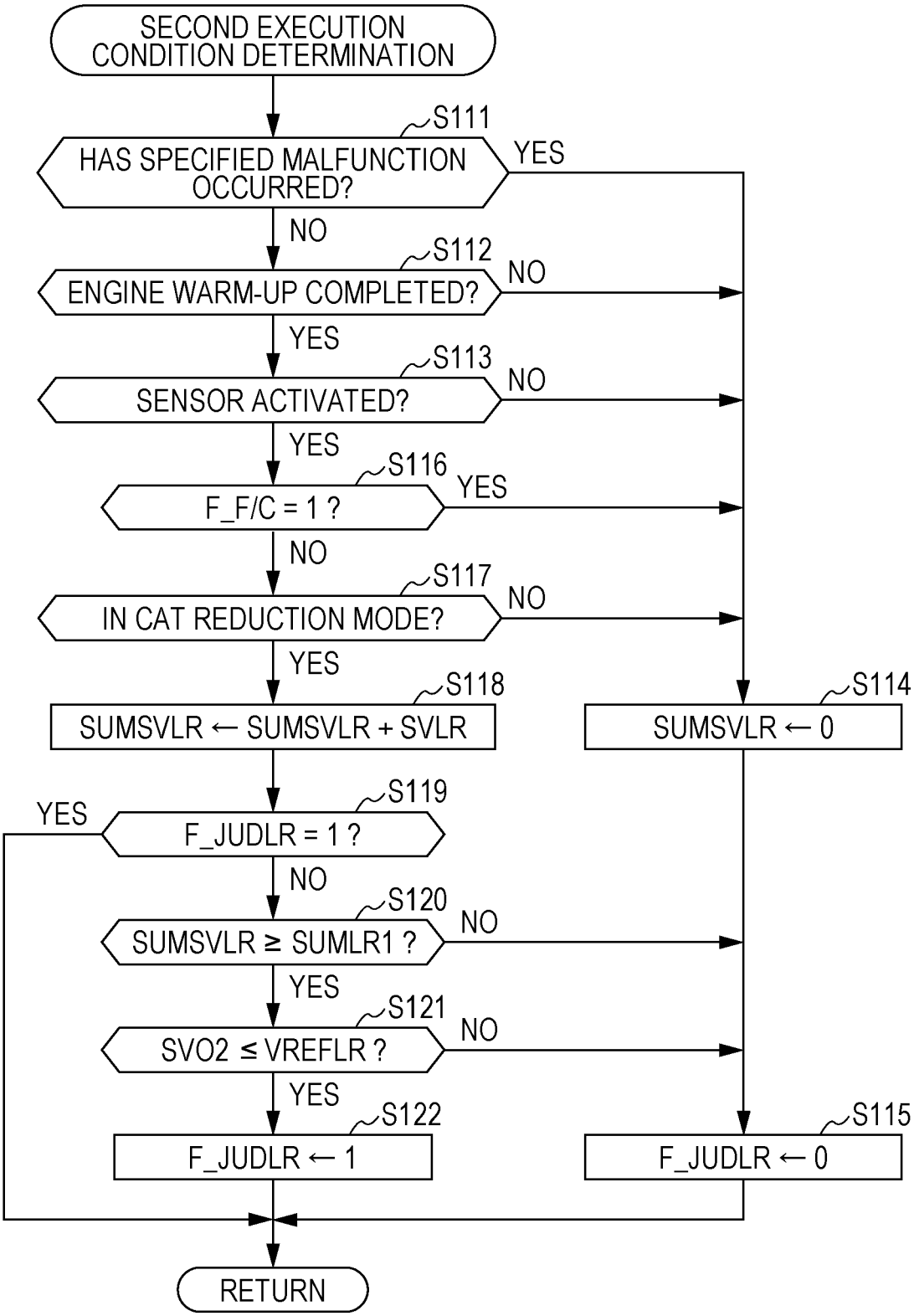
FIG. 9 is a flowchart illustrating a subroutine of second execution condition determination processing executed in the second abnormality determination processing in FIG. 8.

First, in steps S111, S112, and S113, in FIG. 9, determination is made the same as with steps S31, 34, and S35, respectively, in FIG. 3, regarding whether or not a specified malfunction has occurred, whether or not warm-up of the engine 3 has been completed, and whether or not the O2 sensor 24 has been activated. In the event that the result of step S111 is YES, or a result of step S112 or S113 is NO, a second exhaust gas flow volume accumulation value SUMSVLR is reset to a value "0" in step S114. In step S115, a second execution condition satisfaction flag F_JUDLR is reset to "0" since the second execution condition is not satisfied, and the current cycle ends.

On the other hand, in the event that the result in step S111 is NO and no specified malfunction is occurring, the result of step S112 is YES and warm-up of the engine 3 has been completed, and also the result of step S113 is YES and the O2 sensor 24 has been activated, determination is made in step S116 and S117 regarding whether or not the fuel cutoff flag F_F/C is "1" and whether or not in the CAT reduction mode, respectively.

In the event that the result of step S116 is YES being under fuel cutoff operation, or in the event that the result of step S117 is NO and not being under CAT reduction mode operation, the steps S114 and S115 are executed as the second execution condition does not hold, and the current cycle ends. The reason why the second execution condition is deemed to not hold when fuel cutoff operation is being executed or when CAT reduction mode is not being executed is as follows. This is because with the second abnormality determination processing, abnormality in response properties of the O2 sensor 24 is determined at the time of switching the air-fuel mixture air-fuel ratio from the lean air-fuel ratio to the rich air-fuel ratio as described above, and switching of operating mode from fuel cutoff operation to CAT reduction mode is used as the switching for the air-fuel mixture air-fuel ratio in this case.

On the other hand, in the event that the result in step S116 is NO while the result in step S117 is YES, i.e., fuel cutoff operation is not being executed and the CAT reduction mode is being executed, in step S118 the second exhaust gas flow volume accumulation value SUMSVLR obtained at this time has added thereto a second exhaust gas flow volume SVLR, thereby calculating the current value for the second exhaust gas flow volume accumulation value SUMSVLR. This second exhaust gas flow volume SVLR is equivalent to the flow volume of the exhaust gas emitted from the engine 3 in this processing cycle, and is calculated in accordance with the detected intake air quantity QA. Also, the second exhaust gas flow volume accumulation value SUMSVLR is equivalent to the accumulated value of the exhaust gas flow volume emitted from starting of the CAT reduction mode due to ending of the fuel cutoff operation up to this time. The reason is as follows.

That is, the determination results of the steps S111 through S113 are obtained before the first fuel cutoff operation is performed after starting the engine 3 in the same way as with the steps S31, S34, and S35, i.e., before the CAT reduction mode is executed due to ending of the first fuel cutoff operation. Additionally, unless the result of step S117 is YES, i.e., unless the CAT reduction mode is started, the second exhaust gas flow volume accumulation value SUMSVLR is held at the value "0" by executing step S114, and also the second exhaust gas flow volume accumulation value SUMSVLR is calculated by adding the flow volume of exhaust gas (second exhaust gas flow volume SVLR) emitted from the engine 3 in the current cycle to the previous value.

In step S119 following the above step S118, determination is made regarding whether or not the second execution condition satisfaction flag F_JUDLR is "1". In the event that the result is NO (F_JUDLR=0), determination is made in step S120 regarding whether or not the second exhaust gas flow volume accumulation value SUMSVLR calculated in step S118 above is equal to or greater than a first predetermined value SUMLR1.

In the event that the result of step S120 above is NO (SUMSVLR<SUMLR1), and the accumulated value of exhaust gas flow volume from the time of starting the CAT reduction mode is smaller than the first predetermined value SUMLR1, the exhaust gas corresponding to the air-fuel mixture air-fuel ratio switched from the lean air-fuel ratio to the rich air-fuel ratio by starting the CAT reduction mode is deemed to have not reached the O2 sensor 24 yet. Also, the second execution condition is determined to be unsatisfied since abnormality of the O2 sensor 24 may not be accurately determined due to this, so the above-described step S115 is executed and the current cycle ends.

On the other hand, in the event that the result of step S120 above is YES (SUMSVLR≥SUMLR1), and the accumulated value of exhaust gas flow volume from the time of starting the CAT reduction mode has reached the first predetermined value SUMLR1, determination is made in step S121 regarding whether or not the O2 sensor output SVO2 is equal to or smaller than a second predetermined output VREFLR.

In the event that the result of step S121 above is NO (SVO2>VREFLR), the exhaust gas air-fuel ratio represented by the O2 sensor output SVO2 is at the rich side, and the second execution condition is determined to be unsatisfied since abnormality of the O2 sensor 24 may not be accurately determined at the time of switching the air-fuel mixture air-fuel ratio from the lean air-fuel ratio to the rich air-fuel ratio, so the above-described step S115 is executed and the current cycle ends.

On the other hand, in the event that the result of step S121 is YES, and the O2 sensor output SVO2 is equal to or smaller than the second predetermined output VREFLR, the second execution condition is determined to be satisfied, the second execution condition satisfaction flag F_JUDLR is set to "1" in step S122, and the current cycle ends. Also, in the event that the result of the above step S119 is YES (F_JUDLR=1) due to execution of step S122, the current cycle ends at that point.

Returning to FIG. 8, in step S83 following the above-described step S82, determination is made regarding whether or not the second execution condition satisfaction flag F_JUDLR is "1". In the event that the result thereof is NO (F_JUDLR=0), and the second executing condition is not satisfied, the later-described second start-point exhaust gas flow volume accumulation value calculation-completed flag F_WDSVO2STLR, second output change amount extremum calculation-completed flag F_HDSVO2LR, second output change period parameter calculation-completed flag F_WDSVO2LR, and second temporary determination-completed flag F_TMPJUDLR are each reset to "0" in steps S84 through S87 respectively, and the current cycle ends.

On the other hand, in the event that the result of step S83 above is YES (F_JUDLR=1), and the second execution condition is satisfied, in step S88 the output change amount DSVO2 obtained at this point is shifted to the previous value DSVO2Z, and also the current value for the output change amount DSVO2 is calculated.

Figure 10:
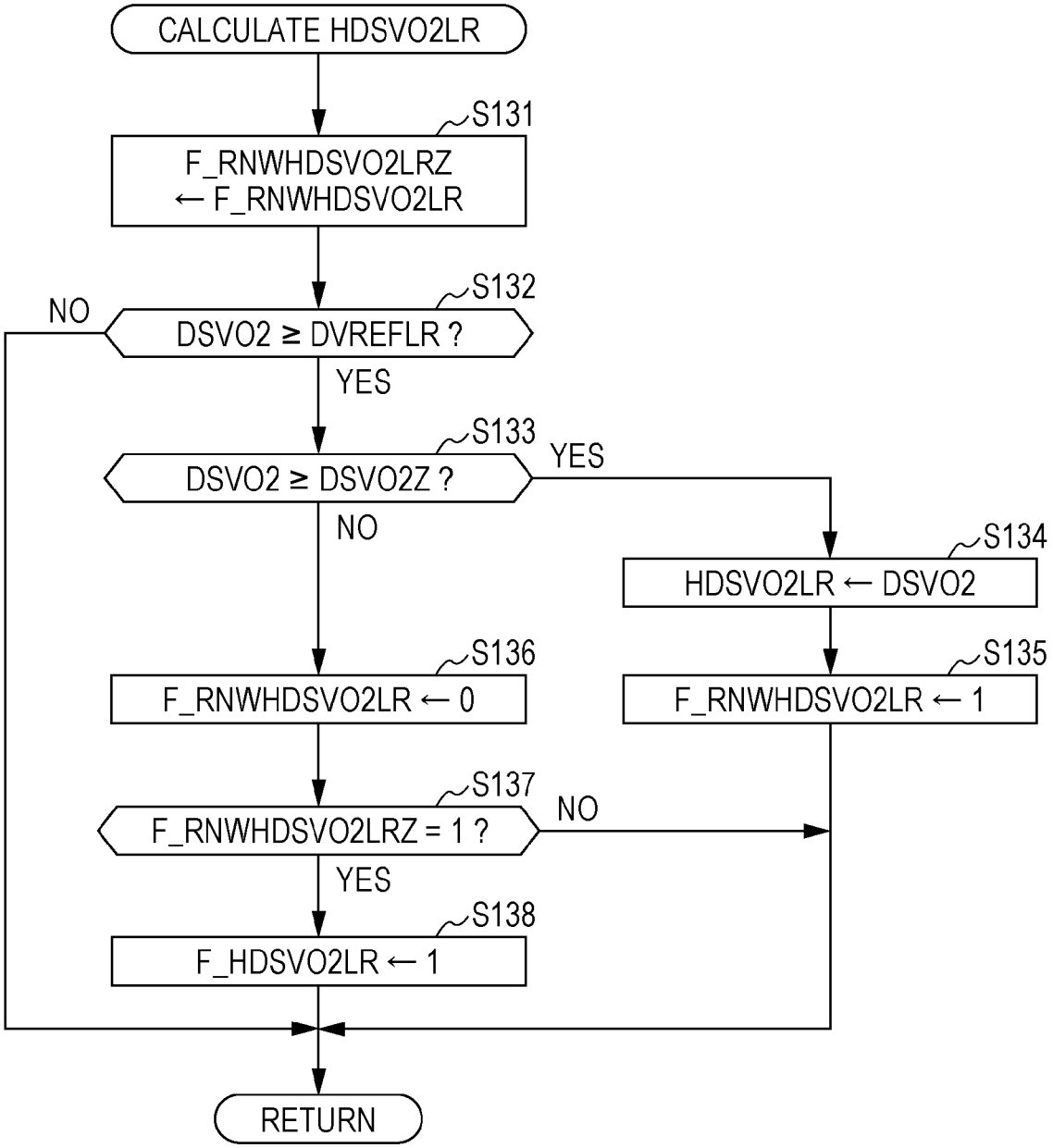
FIG. 10 is a flowchart illustrating a subroutine of HDSVO2LR calculation processing executed in the second abnormality determination processing in FIG. 8.

In step S89 following step S88, HDSVO2LR calculation processing shown in FIG. 10 is executed. As described above, with the second abnormality determination processing including the current cycle, determination is made of an abnormality in response properties of the O2 sensor 24 when switching the air-fuel mixture air-fuel ratio from the lean air-fuel ratio to the rich air-fuel ratio. In this case, the O2 sensor output SVO2 changes from low level to high level by switching of the air-fuel mixture air-fuel ratio to the rich air-fuel ratio opposite to the case of switching the air-fuel mixture air-fuel ratio to the lean air-fuel ratio shown in FIG. 5, and accordingly the output change amount DSVO2 which is the amount of change of the O2 sensor output SVO2 increases from the value "0", and following reaching the positive extremum the value thereof decreases and returns to the value "0" again. With the current cycle, a second output change amount extremum HDSVO2LR is calculated as the extremum of the output change amount DSVO2 within the period from the output change amount DSVO2 reaching a later-described second predetermined change amount DVREFLR until returning to the second predetermined change amount DVREFLR again.

First, in step S131 in FIG. 10, a second output change amount increasing flag F_RNWHDSVO2LR is shifted to the previous value F_RNWHDSVO2LRZ. Details of this second output change amount increasing flag F_RNWHDSVO2LR will be described later.

Next, determination is made in step S132 regarding whether or not the output change amount DSVO2 calculated in step S88 in FIG. 8 is equal to or above the second predetermined change amount DVREFLR. This second predetermined change amount DVREFLR is set to a predetermined positive value such that determination can be made in a sure manner whether or not the output change amount DSVO2 is changing, the absolute value thereof being equal to the above-described first predetermined change amount DVREFRL. In the event that the result of step S132 is NO, the current cycle ends at this point. On the other hand, in the event that the result of step S132 is YES, meaning that the output change amount DSVO2 is equal to or above the second predetermined change amount DVREFLR, determination is made in step S133 regarding whether or not the current value of output change amount DSVO2 is equal to or above the previous value DSVO2Z thereof.

In the event that the result of step S133 is YES and DSVO2≥DSVO2Z, i.e., the output change amount DSVO2 is increasing, the output change amount DSVO2 is set for the second output change amount extremum HDSVO2LR in step S134, the second output change amount increasing flag F_RNWHDSVO2LR is set to "1" in step S135 to indicate that the output change amount DSVO2 is increasing, and the current cycle ends. Note that the second output change amount increasing flag F_RNWHDSVO2LR is reset to "0" when starting the engine 3.

On the other hand, in the event that the result of step S133 is NO and the current value of output change amount DSVO2 is smaller than the previous value DSVO2Z, the second output change amount increasing flag F_RNWHDSVO2LR is set to "0" in step S136 since the output change amount DSVO2 is changing in the direction of decreasing. Next, determination is made in step S137 regarding whether or not the previous value of the first output change amount increasing flag F_RNWHDSVO2LRZ set in step S131 is "1".

In the event that the result of step S137 is YES (F_RNWHDSVO2LRZ=1), this means that calculation (setting) of the second output change amount extremum HDSVO2LR has been completed by execution of step S134 in the previous processing cycle, so in order to represent this, the second output change amount extremum calculation-completed flag F_HDSVO2LR is set to "1" in step S138, and the current cycle ends. On the other hand, in the event that the result of step S137 is NO, i.e., in the event that output change amount DSVO2 is decreasing, the current cycle ends at that point.

The reason why the second output change amount extremum HDSVO2LR is thus calculated is due to the same reason as with the second output change amount extremum HDSVO2LR. Accordingly, detailed description thereof will be omitted.

Figure 11:
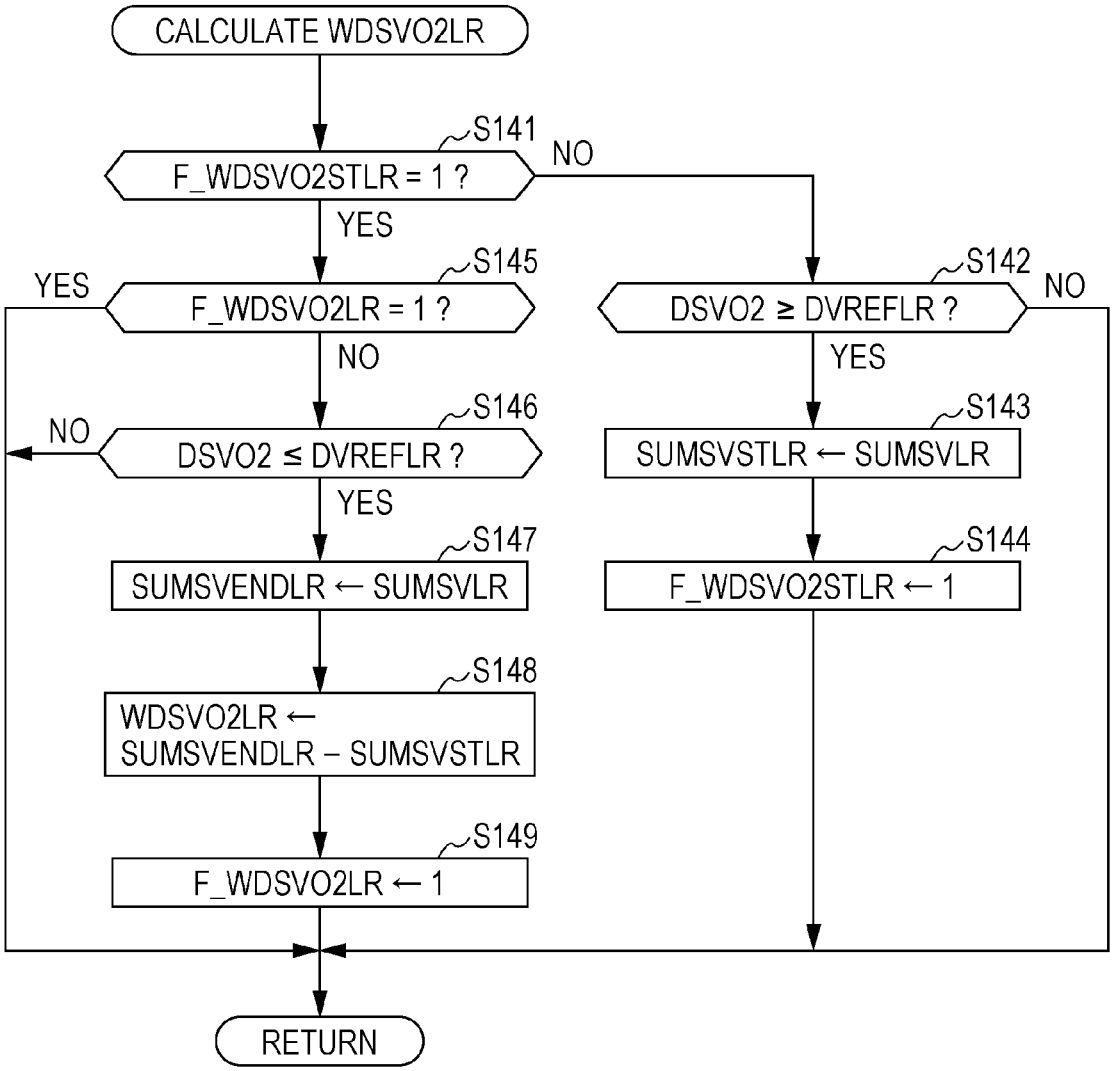
FIG. 11 is a flowchart illustrating a subroutine of WDSVO2LR calculation processing executed in the second abnormality determination processing in FIG. 8.

Returning to FIG. 8, in step S90 following the above step S89, WDSVO2LR calculation processing shown in FIG. 11 is performed. With the current cycle, a second output change period parameter WDSVO2LR which represents the period from the output change amount DSVO2 becoming the second predetermined change amount DVREFLR up to returning to the second predetermined change amount DVREFLR again is calculated.

In step S141 in FIG. 11, determination is made regarding whether or not the second start-point exhaust gas flow volume accumulation value calculation-completed flag F_WDSVO2STLR is "1". This second start-point exhaust gas flow volume accumulation value calculation-completed flag F_WDSVO2STLR is set to "1" when calculation of a later-described second start-point exhaust gas flow volume accumulation value SUMSVSTLR is completed, and is reset to "0" when starting the engine 3.

In the event that the result of step S141 is NO (F_WDSVO2STLR=0), and calculation of the second start-point exhaust gas flow volume accumulation value SUMSVSTLR is not completed, determination is made in step S142 regarding whether or not the output change amount DSVO2 is equal to or above the second predetermined change amount DVREFLR. In the event that the response thereto is NO, the current cycle ends at that point.

On the other hand, in the event that the result of step S142 is YES and the output change amount DSVO2 is equal to or above the second predetermined change amount DVREFLR, the second exhaust gas flow volume accumulation value SUMSVLR calculated in step S118 in FIG. 9 is set as the second start-point exhaust gas flow volume accumulation value SUMSVSTLR in step S143. Next, to represent that calculation (setting) of the second start-point exhaust gas flow volume accumulation value SUMSVSTLR has been completed, the second start-point exhaust gas flow volume accumulation value calculation-completed flag F_WDSVO2STLR is set to "1" in step S144, and the current cycle ends.

As can be clearly understood from the calculation method thereof, the second start-point exhaust gas flow volume accumulation value SUMSVSTLR is equivalent to the accumulation value of the exhaust gas flow volume from starting of the CAT reduction mode until the output change amount DSVO2 reaches the second predetermined change amount DVREFLR.

On the other hand, in the event that the result of step S141 is YES (F_WDSVO2STLR=1) due to execution of step S144 in a previous cycle, determination is made in step S145 regarding whether the second output change period parameter calculation-completed flag F_WDSVO2LR is "1". This second output change period parameter calculation-completed flag F_WDSVO2LR is set to "1" when calculation of the second output change period parameter WDSVO2LR has been completed.

In the event that the result of this step S145 is NO (F_WDSVO2LR=0), and calculation of the second output change period parameter WDSVO2LR has not been completed, determination is made in step S146 regarding whether or not the output change amount DSVO2 is equal or below the second predetermined change amount DVREFLR. In the event that the result thereof is NO, the current cycle ends at that point.

On the other hand, in the event that the result of step S146 is YES and the output change amount DSVO2 is equal to the second predetermined change amount DVREFLR, the second exhaust gas flow volume accumulation value SUMSVLR is set in step S147 as a second end-point exhaust gas flow volume accumulation value SUMSVENDLR. As can be clearly understood from the calculation method thereof, the second end-point exhaust gas flow volume accumulation value SUMSVENDLR is equivalent to the accumulation value of exhaust gas flow volume from starting of the CAT reduction mode until the output change amount DSVO2 returns to the second predetermined change amount DVREFLR again.

Next, in step S148, the second start-point exhaust gas flow volume accumulation value SUMSVSTLR set in step S143 is subtracted from the second end-point exhaust gas flow volume accumulation value SUMSVENDLR set in step S147 above, thereby calculating the second output change period parameter WDSVO2LR. Next, to represent that calculation of the second output change period parameter WDSVO2LR has been completed, in step S149 the second output change period parameter calculation-completed flag F_WDSVO2LR is set to "1", and the current cycle ends.

Also, in the event that the result of step S145 is YES (F_WDSVO2LR=1) due to the processing in step S149 having been performed in a previous cycle, the current cycle ends at that point.

As described above, the second start-point exhaust gas flow volume accumulation value SUMSVSTLR is equivalent to the accumulation value of the exhaust gas flow volume from starting of the CAT reduction mode until the output change amount DSVO2 reaches the second predetermined change amount DVREFLR, and the second end-point exhaust gas flow volume accumulation value SUMSVENDLR is equivalent to the accumulation value of the exhaust gas flow volume from starting of the CAT reduction mode until the output change amount DSVO2 returns to the second predetermined change amount DVREFLR again. Accordingly, the second output change period parameter WDSVO2LR calculated by subtracting the former (SUMSVSTLR) from the latter (SUMSVENDLR) is equivalent to the accumulation value of the exhaust gas flow volume from the output change amount DSVO2 becoming the second predetermined change amount DVREFLR until returning to the second predetermined change amount DVREFLR again, and suitably expresses the period from the output change amount DSVO2 becoming the second predetermined change amount DVREFLR until returning to the second predetermined change amount DVREFLR again.

Returning to FIG. 8, in step S91 following step S90, determination is made regarding whether or not the second exhaust gas flow volume accumulation value SUMSVLR is equal to or above a second predetermined value SUMLR2. In the event that the result thereof is NO (SUMSVLR<SUMRLR2), determination is made in step S92 regarding whether or not the second output change amount extremum calculation-completed flag F_HDSVO2LR set in step S138 in FIG. 10 is "1". In the event that the result thereof is NO, and the second output change amount extremum HDSVO2LR has not been calculated, the flow goes to the above-described step S87, and the current cycle ends.

On the other hand, in the event that the result of step S93 is YES and the second output change amount extremum HDSVO2LR has been calculated, determination is made in step S13 regarding whether or not the second output change period parameter calculation-completed flag F_WDSVO2LR set in step S149 in FIG. 11 is "1". In the event that the result thereof is NO and the second output change period parameter WDSVO2LR has not been calculated, the flow goes to step S87, and the current cycle ends.

On the other hand, in the event that the result of step S93 is YES, i.e., both the second output change amount extremum HDSVO2LR and second output change period parameter WDSVO2LR have been calculated, a ratio of the second output change amount extremum absolute value |HDSVO2LR| set in step S134 in FIG. 10 as to the second output change period parameter WDSVO2LR calculated in step S148 in FIG. 11 (i.e., |HDSVO2LR|/WDSVO2LR) is calculated in step S94 as a second determining parameter KJUDSVO2LR. Next, determination is made in step S95 regarding whether or not the calculated second determining parameter KJUDSVO2LR is equal to or below a second determining value KREFLR.

In the event that the result thereof is YES, and the second determining parameter KJUDSVO2LR is equal to or below the second determining value KREFLR, temporary determination is made that an abnormality is occurring in the response properties of the O2 sensor 24 at the time of switching the air-fuel ratio to the rich air-fuel ratio (hereinafter referred to as "second abnormality"), and in step S96 sets a second temporary abnormality flag F_TMPNGLR to "1" to represent this. Next, the second temporary determination-completed flag F_TMPJUDLR is set to "1" in step S97 to represent that temporary results have been obtained for the second abnormality, and the current cycle ends.

On the other hand, in the event that the result in step S95 described above is NO, and the second determining parameter KJUDSVO2LR is greater than the second determining value KREFLR, temporary determination is made that the second abnormality is not occurring, and in step S98 the second temporary abnormality flag F_TMPNGLR is set to "0" to represent this. Subsequently, the above-described step S97 is executed, and the current cycle ends.

The reason why temporary determination is made for the second abnormality of the O2 sensor 24 as described above is that, as described earlier with reference to FIGS. 19A through 20B, when there is an abnormality at the O2 sensor 24 the second output change amount extremum absolute value |HDSVO2LR| becomes smaller and the second output change period parameter WDSVO2LR becomes greater, resulting in the ratio of the second output change amount extremum absolute value |HDSVO2LR| as to the second determining parameter KJUDSVO2LR, i.e., second output change period parameter WDSVO2LR, dropping to or below the second determining value KREFLR.

Note that once a temporary determination is obtained for the second abnormality in steps S95, S96, and S98, even if the second output change amount extremum HDSVO2LR is calculated again thereafter in a subsequent cycle before YES is obtained in step S81, steps S92 through S98 are not executed, and the results of the temporary determination of the second abnormality are not changed. Accordingly, with the current cycle, in the event that multiple second output change amount extremums HDSVO2LR are calculated as described later with the second embodiment, temporary determination of the second abnormality of the O2 sensor 24 is made based on the relationship between the earliest second output change amount extremum HDSVO2LR and the second output change period parameter WDSVO2LR corresponding thereto.

On the other hand, in the event that the result in step S11 is YES and the second exhaust gas flow volume accumulation value SUMSVLR has reached a second predetermined value SUMRL2, i.e., a great amount of gas has passed over the O2 sensor 24 after starting switching of the air-fuel mixture air-fuel ratio to the rich air-fuel ratio, determination is made in step S99 regarding whether or not the second temporary determination-completed flag F_TMPJUDLR set in step S87 or S97 in a previous cycle is "1". In the event that the result is YES and a determination result has been obtained for the second abnormality, determination is made in step S100 regarding whether or not the second temporary abnormality flag F_TMPNGLR is "1".

In the event that the result thereof is NO (F_TMPNGLR=0), i.e., that a great amount of gas has passed over the O2 sensor 24 after starting switching of the air-fuel mixture air-fuel ratio to the rich air-fuel ratio and also non-occurrence of the second abnormality of the O2 sensor 24 is temporarily determined, the determination that the second abnormality has not occurred is finalized, and a second abnormality flag F_NGLR is set to "0" in step S101 to represent this. Next, the second abnormality determination completion flag F_DONELR is set to "1" in step S102 to represent that abnormality processing according to the current cycle has been completed, and the current cycle ends.

On the other hand, in the event that the result of step S100 is YES (F_TMPNGLR=1), i.e., that a great amount of gas has passed over the O2 sensor 24 after starting switching of the air-fuel mixture air-fuel ratio to the rich air-fuel ratio and also occurrence of the second abnormality of the O2 sensor 24 has been temporarily determined, the determination that the second abnormality has occurred is finalized, and the second abnormality flag F_NGLR is set to "1" in step S103 to represent this. Next, the above-described step S102 is executed, and the current cycle ends.

On the other hand, in the event that the result of step S99 is NO and the second temporary determination-completed flag F_TMPJUDLR is "0", i.e., that a great amount of gas has passed over the O2 sensor 24 after starting switching of the air-fuel mixture air-fuel ratio to the rich air-fuel ratio but temporary determination results of the second abnormality are not obtained since calculation of the second output change amount extremum HDSVO2LR and/or second output change period parameter WDSVO2LR has not been performed, determination that the second abnormality has occurred is finalized, the above-described steps S103 and S102 are executed, and the current cycle ends.

Also, in the event that executing step S102 in a previous cycle results in the result of the above-described step S81 being YES (F_DONELR=1), the second execution condition satisfaction flag F_JUDLR is reset to "0" in step S104, the steps S84 through S87 are executed, and the current cycle ends.

The correlation between the components in the first embodiment and the components laid forth in the Summary is as follows. That is to say, the O2 sensor 24 and three-way catalytic converter 7 in the first embodiment correspond to the air-fuel ratio sensor and catalyst according to the present disclosure, and the ECU2 in the first embodiment corresponds to the air-fuel ratio control unit, output change period parameter calculating unit, output change amount extremum calculating unit, abnormality detecting unit, and exhaust gas flow volume accumulation value calculating unit in the present disclosure.

Also, the output change amount DSVO2 in the first embodiment corresponds to the amount of change of output of the air-fuel ratio sensor in the present embodiment, and the first and second predetermined change amounts DVREDRL and DVREFLR in the first embodiment correspond to predetermined change amounts in the present disclosure. Further, the first and second output change period parameters WDSVO2RL and WDSVO2LR in the first embodiment correspond to the output change period parameter according to the present disclosure, and also the first and second output change amount extremums HDSVO2RL and HDSVO2LR in the first embodiment correspond to the output change amount extremum according to the present disclosure. Also, the first and second determining parameters KJUDSVO2RL and KJUDSVO2LR in the first embodiment correspond to the relation between output change period parameter and output change amount extremum, and ratio of output change amount extremum as to output change period parameter, according to the present disclosure. Further, the first and second exhaust gas flow accumulation values SUMSVRL and SUMSVLR according to the first embodiment correspond to the exhaust gas flow volume accumulation value according to the present disclosure, and the first and second predetermined values SUMRL1 and SUMLR2 in the first embodiment correspond to the third and fourth predetermined values according to the present disclosure, respectively.

Thus, according to the first embodiment, due to the first abnormality determination processing being performed, after switching of the exhaust gas air-fuel ratio from the rich air-fuel ratio to the lean air-fuel ratio having performed, the first output change period parameter WDSVO2RL representing the period from the output change amount DSVO2 reaching the first predetermined change amount DVREFRL and returning to the first predetermined change amount DVREFRL again (hereinafter referred to as "first output change period") due to this switching is calculated (step S68 in FIG. 6). Also, the first output change amount extremum HDSVO2RL which is the extremum of the output change amount DSVO2 obtained during the first output change period, represented by the first output change period parameter WDSVO2RL, is calculated (step S54 in FIG. 4). Further, first abnormality determination is made for the O2 sensor 24 (steps S14 through S16 and S18 in FIG. 2), based on the ratio of the first output change amount extremum absolute value |HDSVO2RL| as to the calculated first output change period parameter WDSVO2RL.

Also, due to the second abnormality determination processing being performed, after switching of the exhaust gas air-fuel ratio from the lean air-fuel ratio to the rich air-fuel ratio having performed, the second output change period parameter WDSVO2LR representing the period from the output change amount DSVO2 reaching the second predetermined change amount DVREFLR and returning to the second predetermined change amount DVREFLR again (hereinafter referred to as "second output change period") due to this switching is calculated (step S148 in FIG. 11). Also, the second output change amount extremum HDSVO2LR which is the extremum of the output change amount DSVO2 obtained during the second output change period, represented by the second output change period parameter WDSVO2LR, is calculated (step S134 in FIG. 10). Further, second abnormality determination is made for the O2 sensor 24 (steps S94 through S96 and S98 in FIG. 8), based on the ratio of the second output change amount extremum absolute value |HDSVO2LR| as to the calculated second output change period parameter WDSVO2LR.

Accordingly, even in the event that the amount of change of exhaust gas air-fuel ratio is relatively small due to effects of exhaust gas air-fuel ratio lag described with reference to FIGS. 20A and 20B, first abnormality of the O2 sensor 24 can be accurately determined based on the relation between the first output change period parameter WDSVO2RL and the first output change amount extremum HDSVO2RL. In the same way, second abnormality of the O2 sensor 24 can be accurately determined based on the relation between the second output change period parameter WDSVO2LR and the second output change amount extremum HDSVO2LR.

Also, the period from the output change amount DSVO2 reaching the first predetermined change amount DVREFRL up to returning to the first predetermined change amount DVREFRL again can be calculated as the first output change period parameter WDSVO2RL, thereby preventing the first abnormality determination from being made based on the first output change period in a case where the output of the air-fuel ratio sensor has temporarily slightly fluctuated due to external disturbances such as noise or the like. In the same way, the period from the output change amount DSVO2 reaching the second predetermined change amount DVREFLR up to returning to the second predetermined change amount DVREFLR again can be calculated as the second output change period parameter WDSVO2LR, thereby preventing the second abnormality determination from being made based on the second output change period in a case where the output of the air-fuel ratio sensor has temporarily slightly fluctuated due to external disturbances such as noise or the like.

Further, even in the event that the response properties of the O2 sensor 24 are not the same when switching the air-fuel mixture air-fuel ratio to the lean air-fuel ratio (hereinafter also referred to as "switching to lean air-fuel ratio") and when switching the air-fuel mixture air-fuel ratio to the rich air-fuel ratio (hereinafter also referred to as "switching to rich air-fuel ratio"), the first abnormality which is an abnormality of the O2 sensor 24 when switching to lean air-fuel ratio and the second abnormality which is an abnormality of the O2 sensor 24 when switching to rich air-fuel ratio can both be accurately determined.

Also, determination of the first abnormality of the O2 sensor 24 is performed based on the ratio of the first output change amount extremum absolute value |HDSVO2RL| as to the first determining parameter KJUDSVO2RL, i.e., the calculated first output change period parameter WDSVO2RL, and accordingly can be suitably performed directly based on the relation between the first output change period and the first output change amount extremum HDSVO2RL. In the same way, determination of the second abnormality of the O2 sensor 24 is performed based on the ratio of the second output change amount extremum absolute value |HDSVO2LR| as to the second determining parameter KJUDSVO2LR, i.e., the calculated second output change period parameter WDSVO2LR, and accordingly can be suitably performed directly based on the relation between the second output change period and the second output change amount extremum HDSVO2LR.

Further, the O2 sensor 24 has output properties that the output change amount DSVO2 as to the exhaust gas air-fuel ratio is the greatest when the exhaust gas air-fuel ratio is near the stoichiometric exhaust gas air-fuel ratio, and the air-fuel mixture air-fuel ratio is switched between a lean air-fuel ratio which is leaner than the stoichiometric exhaust gas air-fuel ratio and a rich air-fuel ratio which is richer than the stoichiometric exhaust gas air-fuel ratio, so the calculated first and second determining parameters KJUDSVO2RL and KJUDSVO2LR each represent in an excellent manner whether or not the first and second abnormalities of the O2 sensor 24 are occurring. Accordingly, the above-described advantage, i.e., the advantage that the first and second abnormalities of the air-fuel ratio sensor can be accurately determined even in the event that the amount of change of the exhaust gas air-fuel ratio is small due to the effects of the exhaust gas air-fuel ratio lag, can be effectively obtained.

Also, the three-way catalytic converter 7 is disposed upstream of the O2 sensor 24, so even in the event that there are inconsistencies in exhaust gas air-fuel ratio among the cylinders of the engine 3, the exhaust gas is mixed at the three-way catalytic converter 7, so effects of fluctuation of exhaust gas air-fuel ratio due to such inconsistencies on abnormality determination can be suppressed.

Further, in the first abnormality determining processing, switching of the air-fuel mixture air-fuel ratio to the lean air-fuel ratio is performed using switching of the operating mode to fuel cutoff operation (step S36 in FIG. 3), and the first exhaust gas flow accumulation value SUMSVRL which is an accumulation value of the exhaust gas flow volume after the fuel cutoff operation has been started is calculated (step S37 in FIG. 3). In the event that the first abnormality determination of the O2 sensor 24 based on the first determining parameter KJUDSVO2RL has ended before the period (hereinafter referred to as "first determination period") from the calculated first exhaust gas flow accumulation value SUMSVRL reaching the first predetermined value SUMRL1 (YES in step S39 in FIG. 3) up to reaching the second predetermined value SUMRL2 (YES in step S11 in FIG. 2), the first abnormality of the O2 sensor 24 is finalized based on this determination result (steps S20, S21, and S23).

Further, in the second abnormality determining processing, switching of the air-fuel mixture air-fuel ratio to the rich air-fuel ratio is performed using switching of the operating mode to the CAT reduction mode (steps S116 and S117 in FIG. 9), and the second exhaust gas flow accumulation value SUMSVLR which is an accumulation value of the exhaust gas flow volume after the CAT reduction mode has been started is calculated (step S118 in FIG. 9). In the event that the second abnormality determination of the O2 sensor 24 based on the second determining parameter KJUDSVO2LR has ended before the period (hereinafter referred to as "second determination period") from the calculated first exhaust gas flow accumulation value SUMSVRL reaching the first predetermined value SUMRL1 (YES in step S120 in FIG. 9) up to reaching the second predetermined value SUMRL2 (YES in step S91 in FIG. 8), the second abnormality of the O2 sensor 24 is finalized based on this determination result (steps S100, S101, and S103).

In this way, after the first exhaust gas flow accumulation value SUMSVRL has reached the first predetermined value SUMRL1 following starting the fuel cutoff operation, i.e., following starting of switching of the air-fuel mixture air-fuel ratio to the lean air-fuel ratio, abnormality of the O2 sensor 24 is finalized based on the determination results of the first abnormality of the O2 sensor 24 obtained at that time. Accordingly, after starting of the switching of the air-fuel mixture air-fuel ratio to the lean air-fuel ratio, abnormality of the O2 sensor 24 can be suitably determined while compensating for wasted time from the exhaust gas generated by the air-fuel mixture of the lean air-fuel ratio burning until reaching the O2 sensor 24.

In the same way, after the second exhaust gas flow accumulation value SUMSVLR has reached the first predetermined value SUMRL1 following starting the CAT reduction mode, i.e., following starting of switching of the air-fuel mixture air-fuel ratio to the rich air-fuel ratio, abnormality of the O2 sensor 24 is finalized based on the determination results of the second abnormality of the O2 sensor 24 obtained at that time. Accordingly, after starting of the switching of the air-fuel mixture air-fuel ratio to the rich air-fuel ratio, abnormality of the O2 sensor 24 can be suitably determined while compensating for wasted time from the exhaust gas generated by the air-fuel mixture of the rich air-fuel ratio burning until reaching the O2 sensor 24.

Also, in the case of an abnormality of the O2 sensor 24, the O2 sensor output SVO2 hardly changes even if a great amount of exhaust gas passes over the O2 sensor 24 immediately after starting switching of the air-fuel mixture air-fuel ratio to the lean air-fuel ratio, and as a result, calculation of at least one of the first output change period parameter WDSVO2RL and the first output change amount extremum HDSVO2RL will not be completed. In the same way, in the case of an abnormality of the O2 sensor 24, the O2 sensor output SVO2 hardly changes even if a great amount of exhaust gas passes over the O2 sensor 24 immediately after starting switching of the air-fuel mixture air-fuel ratio to the rich air-fuel ratio, and as a result, calculation of at least one of the second output change period parameter WDSVO2LR and the second output change amount extremum HDSVO2LR will not be completed.

In contrast with this, with the first abnormality determination processing, in the event that calculation of the first output change period parameter WDSVO2RL and first output change amount extremum HDSVO2RL is not completed (NO in step S19 in FIG. 2) even after the first exhaust gas flow accumulation value SUMSVRL exceeds the second predetermined value SUMRL2 (YES in step S11 in FIG. 2) after starting switching of the air-fuel mixture air-fuel ratio to the lean air-fuel ratio, i.e., even after a great amount of exhaust gas has passed over the air-fuel ratio sensor, determination that there is an air-fuel ratio sensor abnormality is finalized (step S23). Accordingly, abnormality of the air-fuel ratio sensor can be accurately determined.

In the same way, with the second abnormality determination processing, in the event that calculation of the second output change period parameter WDSVO2LR and second output change amount extremum HDSVO2LR is not completed (NO in step S99 in FIG. 8) even after the second exhaust gas flow accumulation value SUMSVLR exceeds the second predetermined value SUMRL2 (YES in step S91 in FIG. 8) after starting switching of the air-fuel mixture air-fuel ratio to the rich air-fuel ratio, i.e., even after a great amount of exhaust gas has passed over the O2 sensor 24, determination that there is a second abnormality of the O2 sensor 24 is finalized (step S103). Accordingly, second abnormality of the O2 sensor 24 can be accurately determined.

Also, even if the response properties of the O2 sensor 24 are the same, the smaller the exhaust gas flow volume passing over the O2 sensor 24 is, the longer the first output change period is. On the other hand, with the above-described first embodiment, the first output change period parameter WDSVO2RL is expressed not in terms of time but by exhaust gas flow volume, so determination of the first abnormality can be accurately performed in accordance to the flow volume of the exhaust gas. In the same way, the second output change period parameter WDSVO2LR is expressed not in terms of time but by exhaust gas flow volume, so determination of the second abnormality can be accurately performed in accordance to the flow volume of the exhaust gas.

Next, first and second abnormality determination processing according to the second embodiment of the present disclosure will be described with reference to FIGS. 12 through 15. This second embodiment differs from the first embodiment only with regard to the point that abnormality determination of the O2 sensor 24 is suspended in the event that a predetermined condition holds. In FIGS. 12 through 15, steps which are the same in the contents of execution with the first embodiment are denoted by the same step numbers. The following description of the first and second abnormality determination processing according to the second embodiment will center on contents of execution which differ from the first embodiment.

Figure 12:
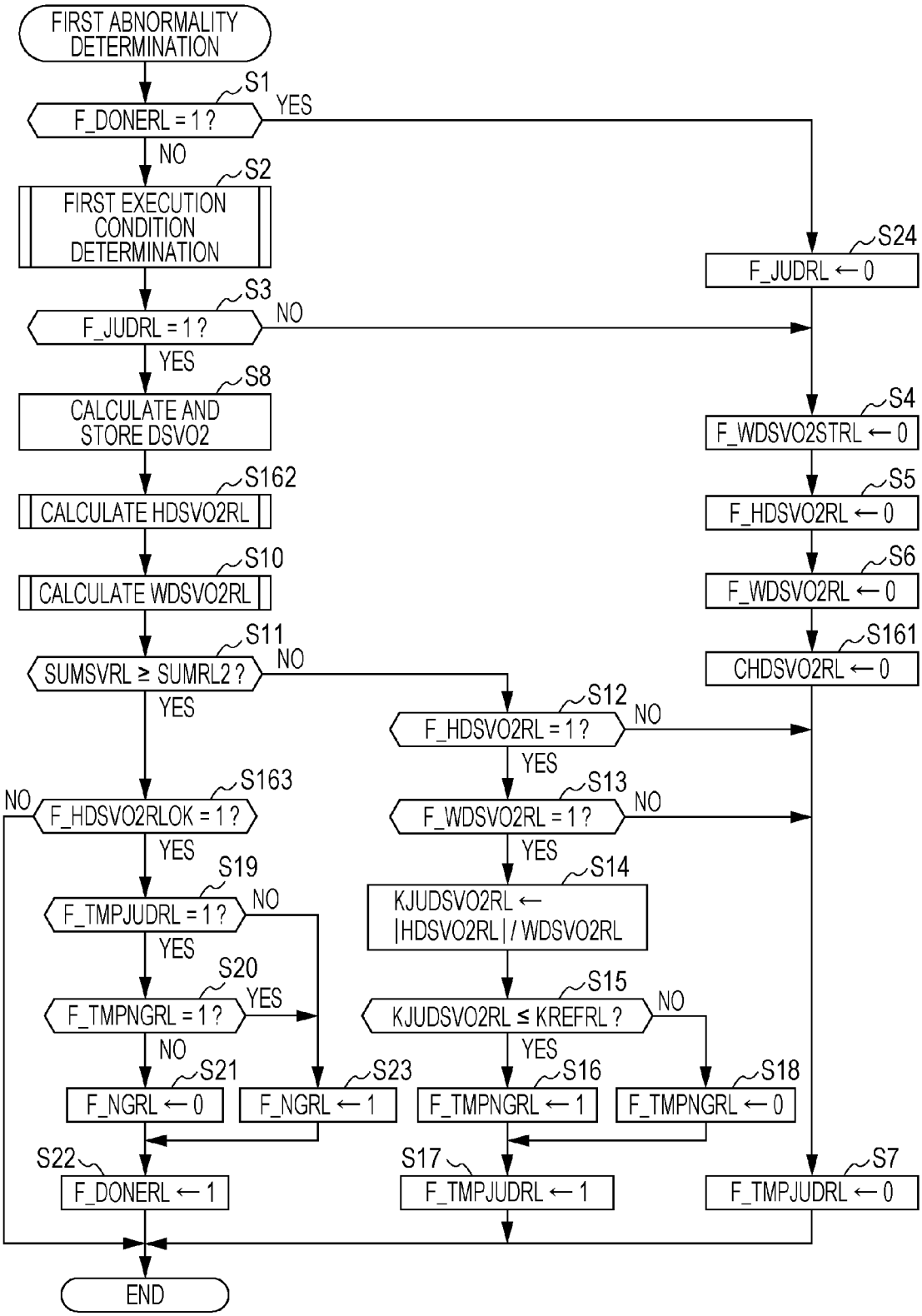
FIG. 12 is a flowchart illustrating a main routine of first abnormality determination processing according to a second embodiment of the present disclosure.

With the first abnormality determination processing shown in FIG. 12, in step S161 following step S6, a first extremum counter value CHDSVO2RL is reset to a value "0". Next, step S7 is executed, and the current cycle ends.

Figure 13:
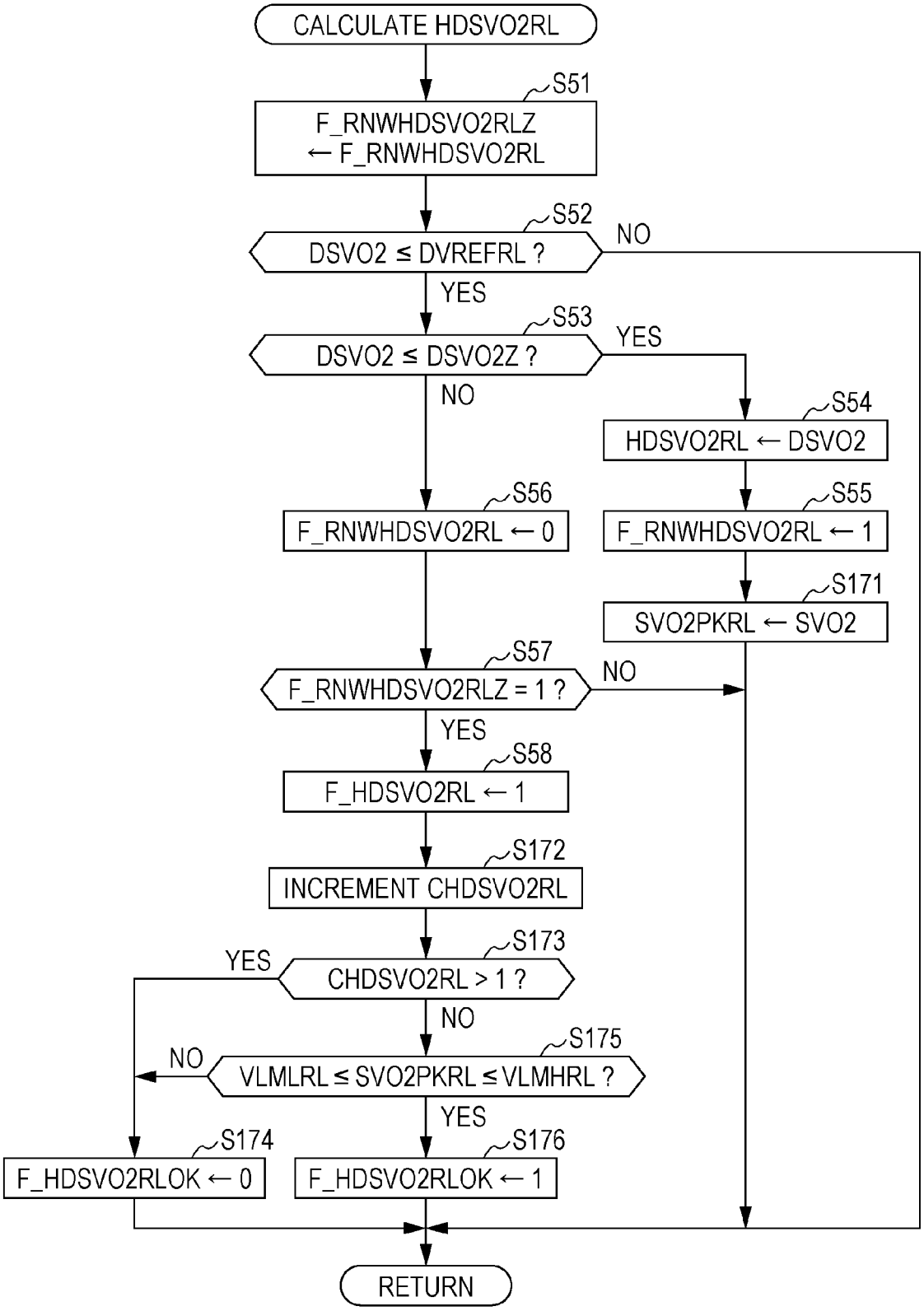
FIG. 13 is a flowchart illustrating a subroutine of HDSVO2RL calculation processing executed in the first abnormality determination processing in FIG. 12.

With step S162 following step S8, the HDSVO2RL calculation processing shown in FIG. 13 is executed. Unlike the HDSVO2RL calculation processing according to the first embodiment shown in FIG. 4, whether or not to suspend the determination of the first abnormality of the O2 sensor 24 is determined based on the O2 sensor output SVO2 regarding which the first output change amount extremum HDSVO2RL has been calculated and the number of times the first output change amount extremum HDSVO2RL has been calculated.

In step S171 following step S55 in FIG. 13, the O2 sensor output SVO2 is set as a first peak output SVO2PKRL, and the current cycle ends. Also, in step S172 following step S58, the first extremum counter value CHDSVO2RL reset in step S161 in FIG. 12 is incremented.

As described with reference to FIG. 4, in the event that the result of step S57 is YES, calculation (setting) of the first output change amount extremum HDSVO2RL is completed, and the first output change amount extremum calculation-completed flag F_HDSVO2RL is set to "1" in step S58. Additionally, unless the first execution condition holds (NO in step S3 in FIG. 12), the first extremum counter value CHDSVO2RL is reset to the value "0" by execution of step S161 in FIG. 12, and also, is incremented by execution of step S172 following step S58. As can be seen from this, the first extremum counter value CHDSVO2RL represents the number of times that the first output change amount extremum HDSVO2RL has been calculated after starting of switching of the air-fuel mixture air-fuel ratio to the lean air-fuel ratio.

With step S173 following step S172, determination is made regarding whether or not the first extremum counter value CHDSVO2RL is greater than a value "1". In the event that the result here is YES, and multiple first output change amount extremums HDSVO2RL have been calculated, a first determination permission flag F_HDSVO2RLOK is set to "0" in step S174 to represent that determination of the first abnormality of the O2 sensor 24 should be suspended, and the current cycle ends.

On the other hand, in the event that the result of step S173 is NO, i.e., in the event that the calculated first output change amount extremum HDSVO2RL is just one, whether or not the first peak output SVO2PKRL set in step S171 is in a first predetermined range stipulated by a first upper limit value VLMHRL and a first lower limit value VLMLRL is determined in step S175. The first lower limit value VLMLRL and first upper limit value VLMHRL are set such that the range of the exhaust gas air-fuel ratio represented by the first predetermined range stipulated by these will be a predetermined range near the stoichiometric exhaust gas air-fuel ratio including the stoichiometric exhaust gas air-fuel ratio. That is to say, the range of exhaust gas air-fuel ratio represented by the first predetermined range is set so as to be a range near the stoichiometric exhaust gas air-fuel ratio between the lean exhaust gas air-fuel ratio corresponding to the lean air-fuel ratio and the rich exhaust gas air-fuel ratio corresponding to the rich air-fuel ratio.

In the event that the result in step S175 is NO, and the first peak output SVO2PKRL is not within the first predetermined range, step S174 is executed since determination of the first abnormality of the O2 sensor 24 should be suspended, and the current cycle ends.

On the other hand, in the event that the result of step S175 is YES, i.e., the calculated first output change amount extremum HDSVO2RL is just one and the first peak output SVO2PKRL is within the first predetermined range, the first determination permission flag F_HDSVO2RLOK is set to "1" in step S176 since determination of the first abnormality of the O2 sensor 24 should be permitted and not suspended, and the current cycle ends.

As described above, in the same way as with the first output change amount extremum HDSVO2RL, as long as the output change amount DSVO2 is smaller than the previous value DSVO2Z thereof (YES in step S53), i.e., as long as the output change amount DSVO2 continues to increase, the first peak output SVO2PKRL is updated by the current output change amount DSVO2 in step S171. As can be clearly understood from this and the calculation method of the first output change amount extremum HDSVO2RL described with the first embodiment, the first peak output SVO2PKRL is equivalent to the O2 sensor output SVO2 obtained when the output change amount DSVO2 reaches the extremum.

Returning to FIG. 12, in the event that the result of step S11 is YES, determination is made in step S163 regarding whether or not the first determination permission flag F_HDSVO2RLOK set in step S174 or S176 in FIG. 13 is "1". In the event that the result is YES (F_HDSVO2RLOK=1) and determination of the first abnormality of the O2 sensor 24 is not suspended but permitted, steps S19 through S23 are executed to finalize determination of the first abnormality as described above, and the current cycle ends.

On the other hand, in the event that the result of step S163 is NO (F_HDSVO2RLOK=0) and determination of the first abnormality of the O2 sensor 24 is suspended, steps S19 through S23 are skipped, and the current cycle ends without finalizing determination of the first abnormality.

Figure 14:
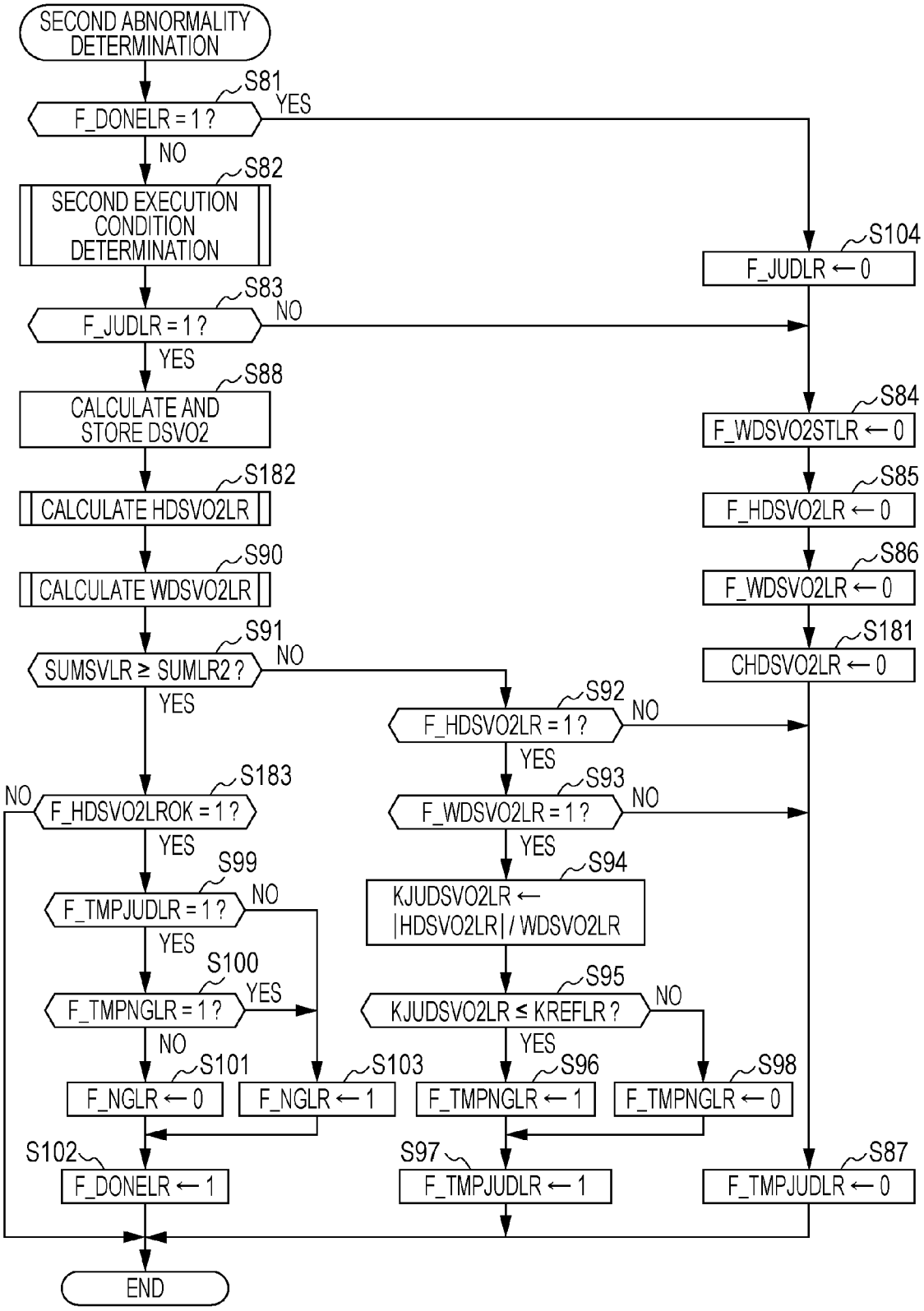
FIG. 14 is a flowchart illustrating a main routine of second abnormality determination processing according to the second embodiment.

With the first abnormality determination processing shown in FIG. 14, in step S181 following step S86, a later-described second extremum counter value CHDSVO2LR is reset to a value "0". Next, step S87 is executed, and the current cycle ends.

Figure 15:
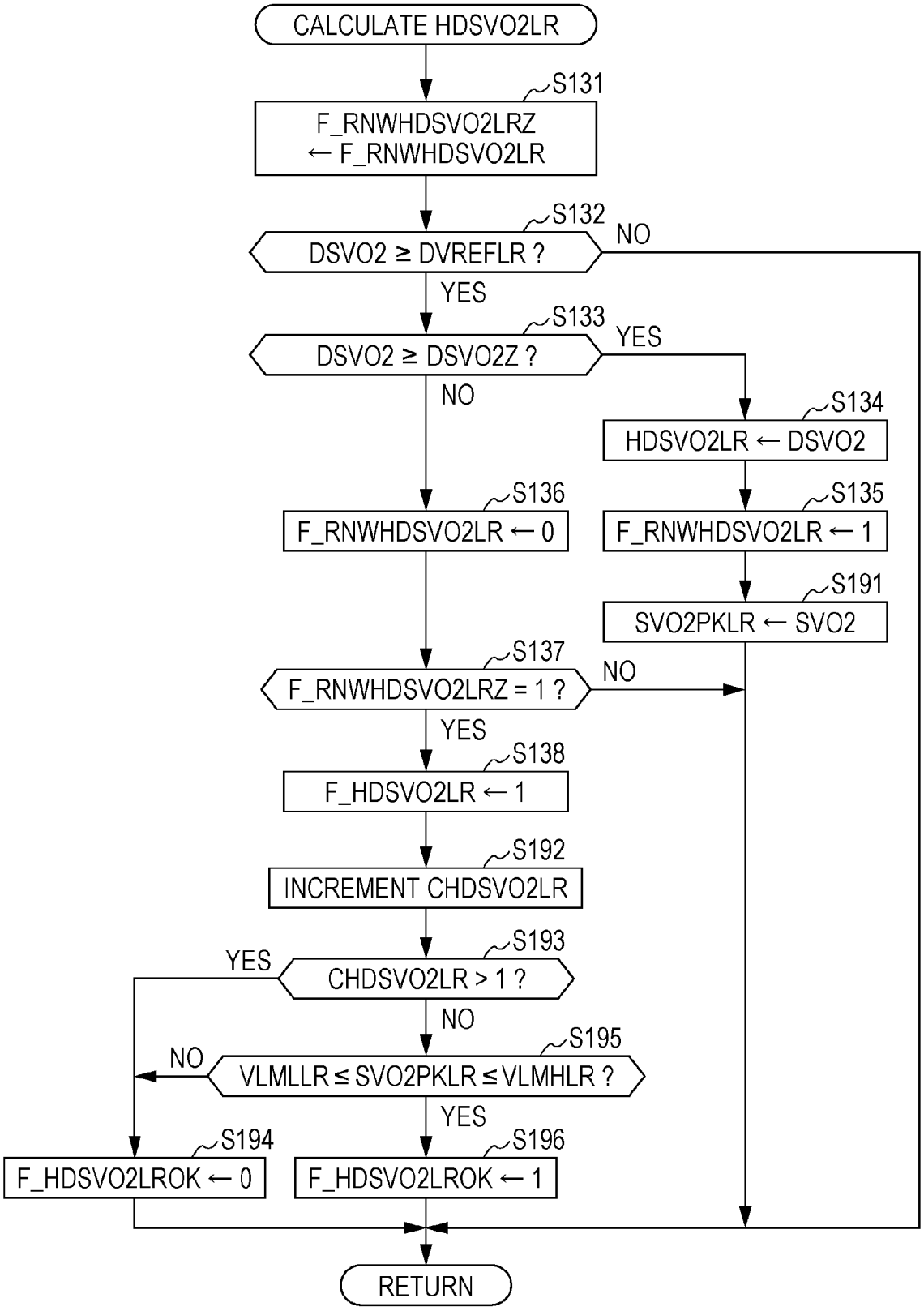
FIG. 15 is a flowchart illustrating a subroutine of HDSVO2LR calculation processing executed in the second abnormality determination processing in FIG. 14.

With step S182 following step S88, the HDSVO2RL calculation processing shown in FIG. 15 is executed. Unlike the HDSVO2LR calculation processing according to the first embodiment shown in FIG. 10, whether or not to suspend the determination of the first abnormality of the O2 sensor 24 is determined based on the O2 sensor output SVO2 regarding which the second output change amount extremum HDSVO2LR has been calculated and the number of times the second output change amount extremum HDSVO2LR has been calculated.

In step S191 following step S135 in FIG. 15, the O2 sensor output SVO2 is set as a second peak output SVO2PKLR, and the current cycle ends. Also, in step S192 following step S138, the second extremum counter value CHDSVO2LR reset in step S181 in FIG. 14 is incremented.

As described with reference to FIG. 10, in the event that the result of step S137 is YES, calculation (setting) of the second output change amount extremum HDSVO2LR is completed, and the second output change amount extremum calculation-completed flag F_HDSVO2LR is set to "1" in step S138. Additionally, unless the second execution condition holds (NO in step S83 in FIG. 14), the second extremum counter value CHDSVO2LR is reset to the value "0" by execution of step S181 in FIG. 14, and also, is incremented by execution of step S192 following step S138. As can be seen from this, the second extremum counter value CHDSVO2LR represents the number of times that the second output change amount extremum HDSVO2LR has been calculated after starting of switching of the air-fuel mixture air-fuel ratio to the rich air-fuel ratio.

With step S193 following step S192, determination is made regarding whether or not the second extremum counter value CHDSVO2LR is greater than a value "1". In the event that the result here is YES, and multiple second output change amount extremums HDSVO2LR have been calculated, a second determination permission flag F_HDSVO2LROK is set to "0" in step S194 to represent that determination of the second abnormality of the O2 sensor 24 should be suspended, and the current cycle ends.

On the other hand, in the event that the result of step S193 is NO, i.e., in the event that the calculated second output change amount extremum HDSVO2LR is just one, whether or not the first peak output SVO2PKRL set in step S191 is in a second predetermined range stipulated by a second upper limit value VLMHLR and a second lower limit value VLMLLR is determined in step S195. The second lower limit value VLMLLR and second upper limit value VLMHLR are set such that the range of the exhaust gas air-fuel ratio represented by the second predetermined range stipulated by these will be a predetermined range near the stoichiometric exhaust gas air-fuel ratio including the stoichiometric exhaust gas air-fuel ratio, in the same way as with the first lower limit value VLMLRL and first upper limit value VLMHRL. That is to say, the second lower limit value VLMLLR and second upper limit value VLMHLR are set such that the range of exhaust gas air-fuel ratio represented by the second predetermined range is a range near the stoichiometric exhaust gas air-fuel ratio between the rich exhaust gas air-fuel ratio and the lean exhaust gas air-fuel ratio.

In the event that the result in step S195 is NO, and the second peak output SVO2PKLR is not within the second predetermined range, step S194 is executed since determination of the second abnormality of the O2 sensor 24 should be suspended, and the current cycle ends.

On the other hand, in the event that the result of step S195 is YES, i.e., the calculated second output change amount extremum HDSVO2LR is just one and the second peak output SVO2PKLR is within the second predetermined range, the second determination permission flag F_HDSVO2LROK is set to "1" in step S196 since determination of the second abnormality of the O2 sensor 24 should be permitted and not suspended, and the current cycle ends.

As described above, in the same way as with the second output change amount extremum HDSVO2LR, as long as the output change amount DSVO2 is equal to or greater than the previous value DSVO2Z thereof (YES in step S133), i.e., as long as the output change amount DSVO2 continues to increase, the second peak output SVO2PKLR is updated by the current output change amount DSVO2 in step S191. As can be clearly understood from this and the calculation method of the second output change amount extremum HDSVO2LR described with the first embodiment, the second peak output SVO2PKLR is equivalent to the O2 sensor output SVO2 obtained when the output change amount DSVO2 reaches the extremum.

Returning to FIG. 14, in the event that the result of step S91 is YES, determination is made in step S183 regarding whether or not the second determination permission flag F_HDSVO2LROK set in step S194 or S196 in FIG. 15 is "1". In the event that the result is YES (F_HDSVO2LROK=0) and determination of the second abnormality of the O2 sensor 24 is suspended, steps S99 through S103 are executed to finalize determination of the second abnormality, and the current cycle ends.

On the other hand, in the event that the result of step S183 is NO (F_HDSVO2LROK=0) and determination of the second abnormality of the O2 sensor 24 is suspended, steps S99 through S103 are skipped, and the current cycle ends without finalizing determination of the second abnormality.

The correlation between the components in the second embodiment and the components laid forth in the Summary is as follows. That is to say, the first and second peak outputs SVO2PKRL and SVO2PKLR are equivalent to the output of the air-fuel ratio when the amount of change of output of the air-fuel ratio sensor according to the present disclosure reaches the extremum.

As described above, according to the second embodiment, after switching the air-fuel mixture air-fuel ratio to the lean air-fuel ratio, the first peak output SVO2PKRL equivalent to the O2 sensor output SVO2 obtained when the output change amount DSVO2 reaches the extremum is calculated (step S171 in FIG. 13). Also, in the event that the first peak output SVO2PKRL is not within the first predetermined range stipulated by the first lower limit value VLMLRL and first upper limit value VLMHRL (NO in step S175 in FIG. 13, NO in step S163 in FIG. 12), determination of the first abnormality of the O2 sensor 24 is suspended. Further, after switching the air-fuel mixture air-fuel ratio to the rich air-fuel ratio, the second peak output SVO2PKLR equivalent to the O2 sensor output SVO2 obtained when the output change amount DSVO2 reaches the extremum is calculated (step S191 in FIG. 15). Also, in the event that the second peak output SVO2PKLR is not within the second predetermined range stipulated by the second lower limit value VLMLLR and second upper limit value VLMHLR (NO in step S195 in FIG. 15, NO in step S183 in FIG. 14), determination of the first abnormality of the O2 sensor 24 is suspended.

In a case of changing the air-fuel mixture air-fuel ratio between the lean air-fuel ratio and rich air-fuel ratio, if there is no exhaust gas air-fuel ratio lag occurring as described above, normally the amount of change of the exhaust gas air-fuel ratio is maximum when the exhaust gas air-fuel ratio is at the stoichiometric exhaust gas air-fuel ratio between the lean exhaust gas air-fuel ratio (the exhaust gas air-fuel ratio corresponding to the lean air-fuel ratio) and the rich exhaust gas air-fuel ratio (the exhaust gas air-fuel ratio corresponding to the rich air-fuel ratio). Accordingly, in the event that exhaust gas air-fuel ratio lag is not occurring, the extremum of the output change amount of the air-fuel ratio sensor occurs when the exhaust gas air-fuel ratio represented by the output of the air-fuel ratio sensor is near the stoichiometric exhaust gas air-fuel ratio.

As can be clearly understood from the above, in the event that the exhaust gas air-fuel ratio represented by the O2 sensor output SVO2 obtained when the output change amount DSVO2 reaches the extremum after switching of the air-fuel mixture air-fuel ratio is not near the above-described stoichiometric exhaust gas air-fuel ratio, there is a possibility that exhaust gas air-fuel ratio lag may be occurring. Further, in this case, in the event that the exhaust gas air-fuel ratio is not within a predetermined exhaust gas air-fuel ratio range including the stoichiometric exhaust gas air-fuel ratio, the amount of change of the exhaust gas air-fuel ratio may be extremely small due to the exhaust gas air-fuel ratio hardly changing and immediately lagging due to occurrence of the above-described exhaust gas air-fuel ratio lag immediately following switching. In such a case, even if the first abnormality and second abnormality are each determined based on the first and second determining parameters KJUDSVO2RL and KJUDSVO2LR, erroneous determination may be made that the first abnormality and second abnormality are occurring when in fact the O2 sensor 24 is normal.

In contrast with this, according to the second embodiment, in the event that the first peak output SVO2PKRL is not within the first predetermined range, determination of the first abnormality of the O2 sensor 24 is suspended, and the range of the exhaust gas air-fuel ratio represented by this first predetermined range is set so as to be a range near the stoichiometric exhaust gas air-fuel ratio between the lean exhaust gas air-fuel ratio and rich exhaust gas air-fuel ratio. Accordingly, determination of the first abnormality can be suspended while exhaust gas air-fuel ratio lag is occurring immediately following switching, so the above-described erroneous determination can be prevented.

In the same way, in the event that the second peak output SVO2PKLR is not within the second predetermined range, determination of the first abnormality of the O2 sensor 24 is suspended, and the range of the exhaust gas air-fuel ratio represented by this second predetermined range is set so as to be a range near the stoichiometric exhaust gas air-fuel ratio between the lean exhaust gas air-fuel ratio and rich exhaust gas air-fuel ratio. Accordingly, determination of the second abnormality can be suspended while exhaust gas air-fuel ratio lag is occurring immediately following switching, so the above-described erroneous determination can be prevented.

Also, when multiple first output change amount extremums HDSVO2RL are calculated (YES in step S173 in FIG. 13, NO in step S163 in FIG. 12), determination of the first abnormality is suspended, and when multiple second output change amount extremums HDSVO2LR are calculated (YES in step S193 in FIG. 15, NO in step S183 in FIG. 14), determination of the second abnormality is suspended. Accordingly, determination of the first abnormality and second abnormality can be suspended while exhaust gas air-fuel ratio lag is occurring immediately following switching, so the above-described erroneous determination can be prevented. Also, advantages of the first embodiment can be obtained in the same way.

Further, upon the first execution condition not holding (NO in step S3) after determination of the first abnormality has been suspended, the various flags are reset to "0" in steps S4 through S7 and S161. Subsequently, upon the first execution condition being satisfied during operating the engine 3, the first output change period parameter WDSVO2RL and the first output change amount extremum HDSVO2RL are calculated again, the determination of the first abnormality is made based on the relation between the calculated first output change period parameter WDSVO2RL and first output change amount extremum HDSVO2RL. This is the same for determination of the second abnormality as well. Accordingly, determination of the first and second abnormalities can be executed again during operating the engine 3, without awaiting for stopping the engine 3 and starting again the next time.

Note that with the first and second embodiments, the first abnormality of the O2 sensor 24 is determined based on the first determining parameter KJUDSVO2RL, i.e., the ratio of the first output change amount extremum absolute value |HDSVO2RL| as to the calculated first output change period parameter WDSVO2RL, but instead of this, but determination may be made based on other suitable parameters representing the relation between the former WDSVO2RL and the latter HDSVO2RL, e.g., the following parameters (A) through (H).

(A) the ratio of the first output change amount extremum HDSVO2RL itself as to the first output change period parameter WDSVO2RL (B) the inverse of the first determining parameter KJUDSVO2RL, i.e., the ratio (WDSVO2RL/|HDSVO2RL|) of the first output change period parameter WDSVO2RL as to the first output change amount extremum absolute value |HDSVO2RL| (or first output change amount extremum HDSVO2RL)

(C) deviation between the first output change period parameter WDSVO2RL and the first output change amount extremum HDSVO2RL (WDSVO2RL−HDSVO2RL), or the absolute value of this deviation (D) deviation between the first output change amount extremum HDSVO2RL and the first output change period parameter WDSVO2RL (HDSVO2RL−WDSVO2RL), or the absolute value of this deviation (E) ratio of deviation between the first output change amount extremum HDSVO2RL (or absolute value |HDSVO2RL|) and first output change period parameter WDSVO2RL (or the absolute value of this deviation) as to the WDSVO2RL ((HDSVO2RL−WDSVO2RL)/WDSVO2RL)

(F) inverse of (E) ((WDSVO2RL/(HDSVO2RL−WDSVO2RL))

(G) ratio of deviation between first output change period parameter WDSVO2RL and first output change amount extremum HDSVO2RL (or absolute value |HDSVO2RL|) (or the absolute value of this deviation) as to the first output change period parameter WDSVO2RL ((WDSVO2RL−HDSVO2RL)/WDSVO2RL)

(H) inverse of (G) (WDSVO2RL/(WDSVO2RL−|HDSVO2RL|)

Also, with the second embodiment, determination of the first abnormality is permitted without suspension in the event that multiple first output change amount extremums HDSVO2RL are calculated and also the first peak output SVO2PKRL is within the first predetermined range, but an arrangement may be made wherein determination of the first abnormality is permitted when only one of these conditions is satisfied. In the same way, with the second embodiment, determination of the second abnormality is permitted without suspension in the event that multiple second output change amount extremums HDSVO2LR are not calculated and also the second peak output SVO2PKLR is within the second predetermined range, but an arrangement may be made wherein determination of the second abnormality is permitted when only one of these conditions is satisfied.

Next, first and second abnormality determination processing according to a third embodiment of the present disclosure will be described with reference to FIGS. 16 through 18. This third embodiment shown in FIG. 16 differs from the first embodiment only with regard to the point that the first abnormality of the O2 sensor 24 is determined based on the comparison results between the first determining threshold HDREFRL calculated based on the first output change period parameter WDSVO2RL and the first output change amount extremum HDSVO2RL, rather than the first determining parameter KJUDSVO2RL, i.e., the ratio of the first output change amount extremum absolute value |HDSVO2RL| as to the first output change period parameter WDSVO2RL.

Figure 16:
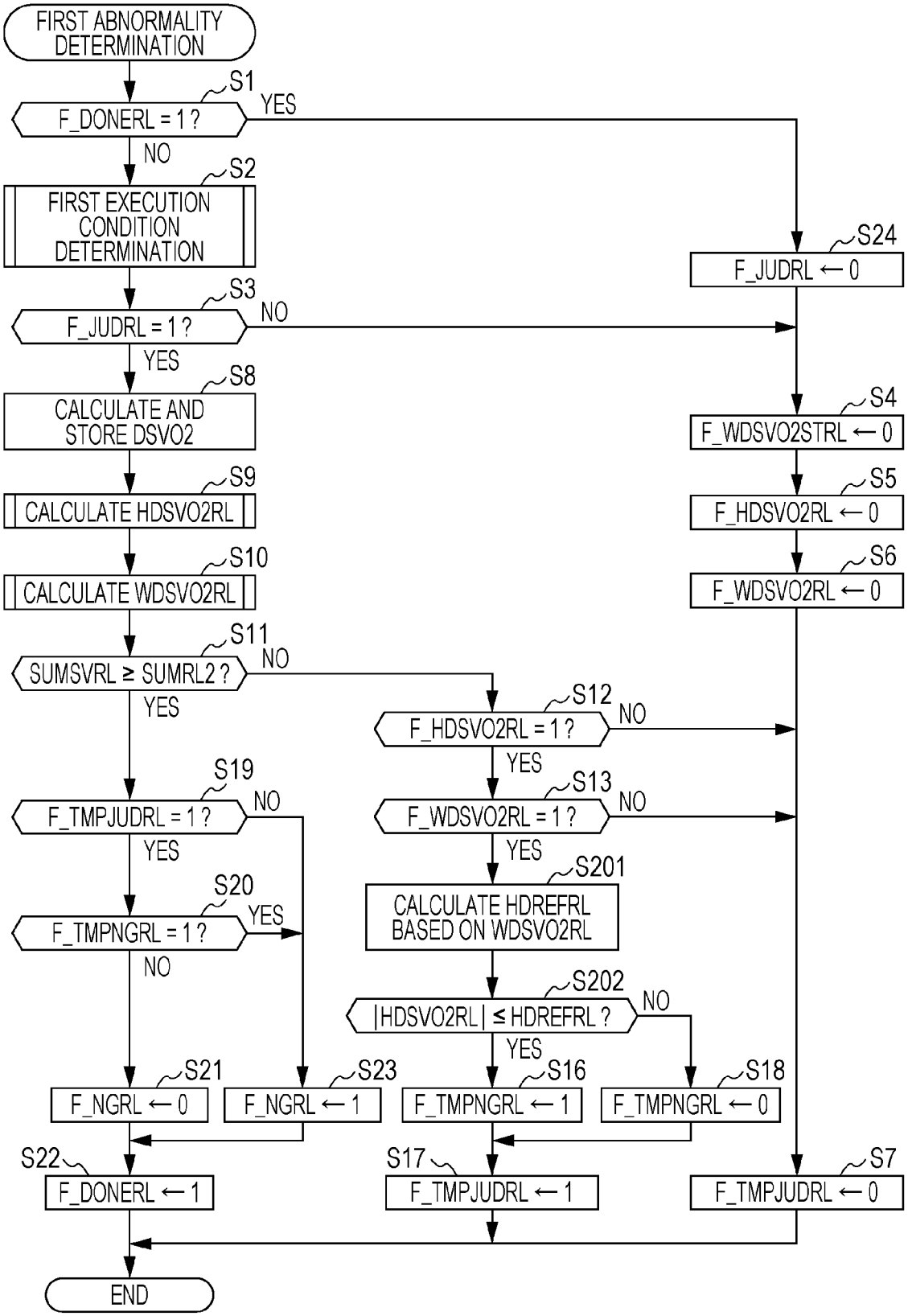
FIG. 16 is a flowchart illustrating a main routine of first abnormality determination processing according to a third embodiment of the present disclosure.

In FIG. 16, steps which are the same in the contents of execution with the first abnormality determination processing in the first embodiment are denoted by the same step numbers. As can be clearly understood by comparing FIG. 16 with FIG. 2, there only difference is that steps S201 and S202 are executed instead of the steps S14 and S15, so the following description will be made mainly regarding this point.

Figure 17:
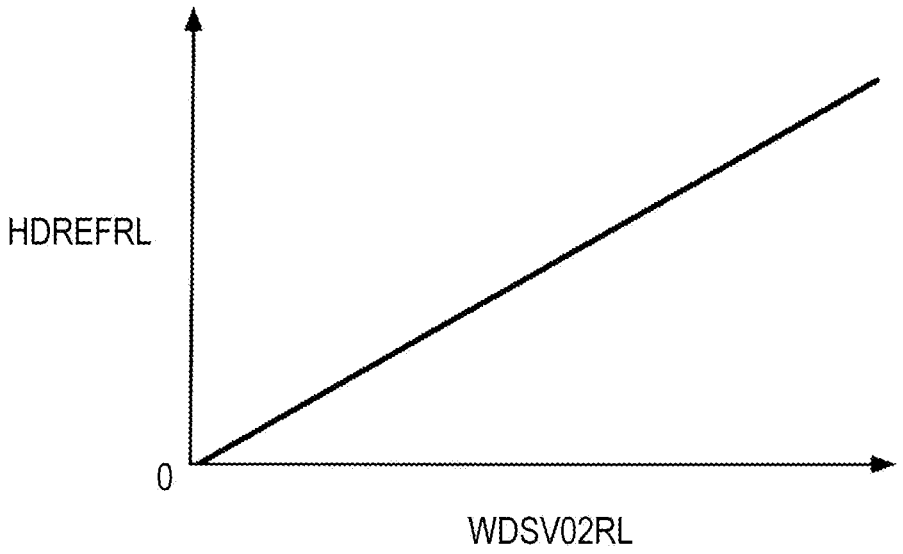
FIG. 17 is an example of a map used in the first abnormality determination processing in FIG. 16.

In the event that the result of step S13 is YES, in step S201 the first determining threshold HDREFRL is calculated by searching a map shown in FIG. 17 based on the first output change period parameter WDSVO2RL calculated in step S68 of FIG. 6. With this map, the first output change amount extremum HDSVO2RL is set to be linearly proportionate to the first output change period parameter WDSVO2RL.

Next, determination is made in step S202 regarding whether or not the first output change amount extremum absolute value |HDSVO2RL| set in step S54 in FIG. 4 is equal to or smaller than the first determining threshold HDREFRL calculated in step S201. In the event that the result is YES, temporary determination is made that the first abnormality of the O2 sensor 24 is occurring, so step S16 is executed, the first temporary abnormality flag F_TMPNGRL is set to "1", step S17 is executed, and the current cycle ends.

On the other hand, in the event that the result of step S202 is NO and the first output change amount extremum absolute value |HDSVO2RL| is greater than the first determining threshold HDREFRL, temporary determination is made that the first abnormality of the O2 sensor 24 is not occurring, so step S18 is executed, the first temporary abnormality flag F_TMPNGRL is set to "0", step S17 is executed, and the current cycle ends.

Figure 18:
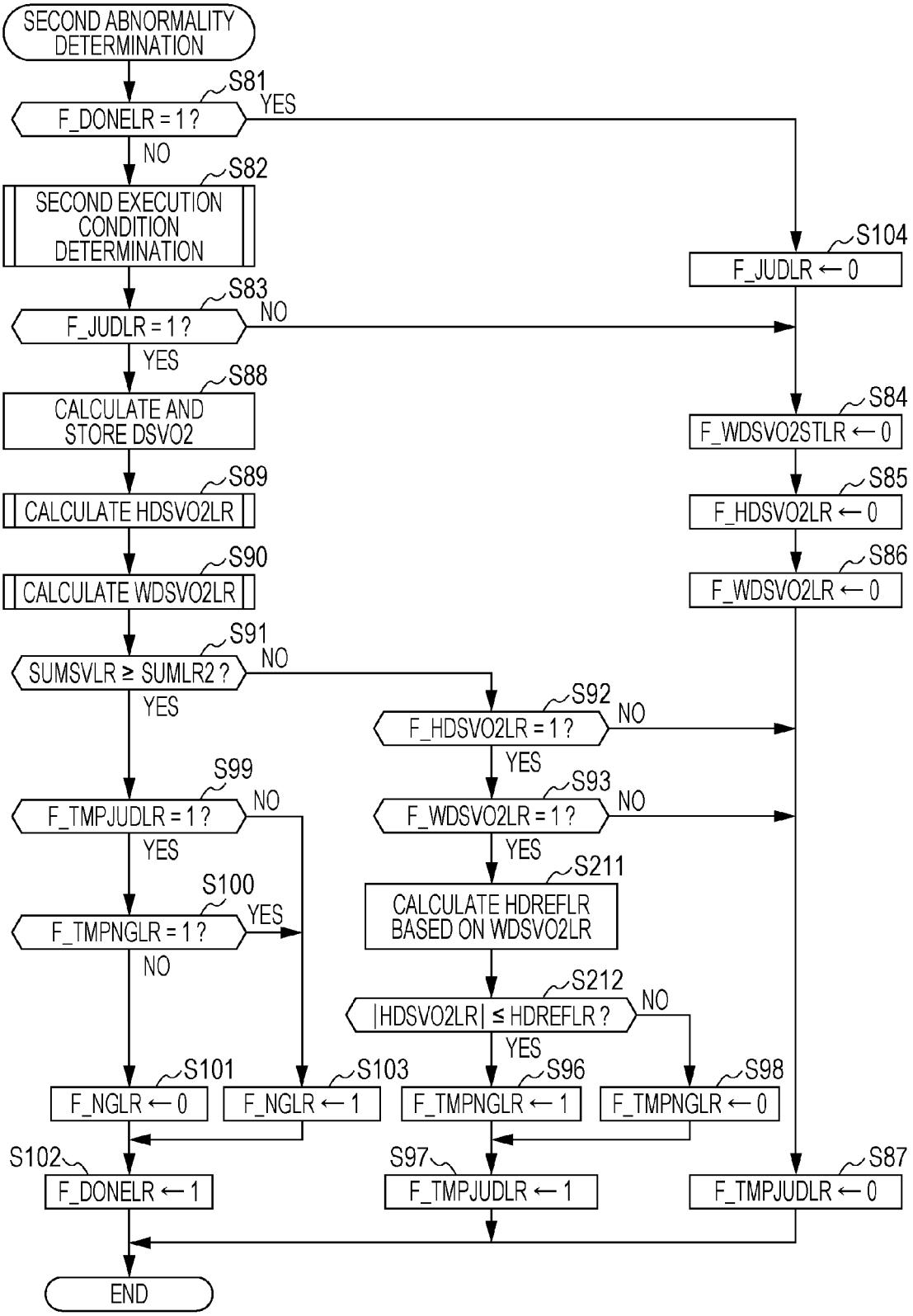
FIG. 18 is a flowchart illustrating a main routine of second abnormality determination processing according to the third embodiment.

Also, the second abnormality determination according to the third embodiment shown in FIG. 18 differs from the first embodiment only with regard to the point that the second abnormality of the O2 sensor 24 is determined based on a second determining threshold HDREFLR calculated based on the second output change period parameter WDSVO2LR and the second output change amount extremum HDSVO2LR, rather than the second determining parameter KJUDSVO2LR, i.e., the ratio of the second output change amount extremum absolute value |HDSVO2LR| as to the second output change period parameter WDSVO2LR.

In FIG. 18, steps which are the same in the contents of execution with the second abnormality determination processing in the first embodiment are denoted by the same step numbers. As can be clearly understood by comparing FIG. 18 with FIG. 8, there only difference is that steps S211 and S212 are executed instead of the steps S94 and S95, so the following description will be made mainly regarding this point.

In the event that the result of step S93 is YES, in step S211 the second determining threshold HDREFLR is calculated by searching an unshown map based on the second output change period parameter WDSVO2LR calculated in step S148 of FIG. 11. With this map, the second output change amount extremum HDSVO2LR is set to be linearly proportionate to the second output change period parameter WDSVO2LR, in same way as with setting of the first output change amount extremum HDSVO2RL based on the first output change period parameter WDSVO2RL.

Next, determination is made in step S212 regarding whether or not the second output change amount extremum absolute value |HDSVO2LR| set in step S134 in FIG. 10 is equal to or smaller than the second determining threshold HDREFLR calculated in step S211. In the event that the result is YES, temporary determination is made that the second abnormality of the O2 sensor 24 is occurring, so step S96 is executed, the second temporary abnormality flag F_TMPNGLR is set to "1", step S97 is executed, and the current cycle ends.

On the other hand, in the event that the result of step S212 is NO and the second output change amount extremum absolute value |HDSVO2LR| is greater than the second determining threshold HDREFLR, temporary determination is made that the second abnormality of the O2 sensor 24 is not occurring, so step S98 is executed, the second temporary abnormality flag F_TMPNGLR is set to "0", step S97 is executed, and the current cycle ends.

Also, the correlation between the components in the third embodiment and the components laid forth in the Summary is as follows. That is to say, the first and second determining thresholds HDREFRL and HDREFLR are equivalent to the first threshold value.

Thus, the same advantages as with the first embodiment can be obtained with the third embodiment.

Note that with the third embodiment, the first abnormality of the O2 sensor 24 is calculated based on the comparison results between the first output change amount extremum HDSVO2RL calculated based on the first output change period parameter WDSVO2RL and the first output change amount extremum HDSVO2RL, but reversely, the first abnormality of the O2 sensor 24 may be calculated based on the comparison results between the threshold value calculated based on the first output change amount extremum HDSVO2RL and the first output change period parameter WDSVO2RL. This holds for the second determining threshold value HDREFLR and the second output change amount extremum HDSVO2LR as well.

While suspending of determination of the first and second abnormalities described with the second embodiment (steps S173 through S176 in FIG. 13, step S163 in FIG. 12, steps S193 through S196 in FIG. 15, step S183 in FIG. 14) is not performed with the third embodiment, this may be performed. In this case, unlike the case of the second embodiment, the first abnormality determination may be permitted without suspension in the event that one condition holds of the condition that multiple first output change amount extremums HDSVO2RL have not been calculated and the condition that the first peak output SVO2PKRL is within the first predetermined range. This holds for suspension of determination of the second abnormality as well.

Also, with the first and third embodiment, in the event that multiple first output change amount extremums HDSVO2RL are calculated as with the second embodiment, determination of the first abnormality is performed based on the relation between the earliest first output change amount extremum HDSVO2RL and the first output change period parameter WDSVO2RL corresponding thereto, but an arrangement may be made wherein the first abnormality of the O2 sensor 24 is determined based on the relation between the greatest first output change amount extremum HDSVO2RL of the multiple HDSVO2RL values and the corresponding first output change period parameter WDSVO2RL. Alternatively, of the multiple first output change amount extremums HDSVO2RL, determination of the first abnormality may be performed based on the relation between the last-calculated first output change amount extremum HDSVO2RL and the first output change period parameter WDSVO2RL corresponding thereto. These points hold for the second output change amount extremum HDSVO2LR and second output change period parameter WDSVO2LR as well.

Note that the present disclosure is not restricted to the above-described first through third embodiments (hereinafter referred to collectively as "embodiments"), and may be carried out in various forms. For example, while the absolute values of the first predetermined change amount DVREFRL and second predetermined change amount DVREFLR are set to be equal values in the embodiments, these may be set to different values. Also, while the first and second output change period parameters WDSVO2RL and WDSVO2LR represent the flow value of the exhaust gas with the embodiments, these may represent time. Further, the first and second output change amount extremums HDSVO2RL and HDSVO2LR take the value "0" as a reference, but may take a first predetermined change amount DVREFRL and second predetermined change amount DVREFLR as their respective references.

Also, while both first and second abnormality determination processing is performed with the embodiments, an arrangement may be made wherein only one is executed. Further, while the three-way catalytic converter 7 is disposed upstream of the O2 sensor 24 with the embodiments, this three-way catalytic converter 7 may be omitted. Also, while the O2 sensor 24 is a zirconia type with the embodiments, this may be a titania type.

Further, while the air-fuel ratio sensor according to the present disclosure is a so-called two-value O2 sensor 24 with the embodiments, this may be another suitable sensor for detecting the exhaust gas air-fuel ratio, such as the above-described LAF sensor 23 for example. In this case, the lean air-fuel ratio and rich air-fuel ratio do not necessarily have to be set to the lean side and rich side of the stoichiometric air-fuel ratio as described above, and being to the lean side and rich side of each other relatively may be sufficient. Further, in this case, the first predetermined range stipulated by the above-described first lower limit value VLMLRL and first upper limit value VLMHRL is obtained by experimentation of a predetermined exhaust gas air-fuel ratio where the amount of change in the exhaust gas air-fuel ratio is greatest, and the first predetermined range is set as a predetermined range near the predetermined exhaust gas air-fuel ratio including the obtained predetermined exhaust gas air-fuel ratio. This holds for the second lower limit value VLMLLR and second upper limit value VLMHLR as well.

Also, with the embodiments, switching of the air-fuel mixture air-fuel ratio to the lean air-fuel ratio is performed using the switching of operation mode from the enriching operation to fuel cutoff operation, and also switching of the air-fuel mixture air-fuel ratio is performed using switching from the fuel cutoff operation to the CAT reduction mode, but an arrangement may be made wherein, for example, the air-fuel mixture air-fuel ratio is actively switched between the lean air-fuel ratio and rich air-fuel ratio by air-fuel ratio control by way of the fuel injection valve 5 under control of the ECU 2. Alternatively, perturbation control may be used where the air-fuel mixture air-fuel ratio is switched between the lean air-fuel ratio and rich air-fuel ratio to raise the temperature so as to activate the three-way catalytic converter 7. Also, the rich air-fuel ratio at the time of switching the air-fuel mixture air-fuel ratio from the rich air-fuel ratio to the lean air-fuel ratio, and the rich air-fuel ratio at the time of switching the air-fuel mixture air-fuel ratio from the lean air-fuel ratio to the rich air-fuel ratio, may be different, and in the same way, the lean air-fuel ratio at the time of switching the air-fuel mixture air-fuel ratio from the rich air-fuel ratio to the lean air-fuel ratio, and the lean air-fuel ratio at the time of switching the air-fuel mixture air-fuel ratio from the lean air-fuel ratio to the rich air-fuel ratio, may be different.

Further, with the embodiments, after temporary determination of the first and second abnormalities of the O2 sensor 24, finalization of the first and second abnormalities based on this temporary determination is performed awaiting the first and second exhaust gas flow accumulation values SUMSVRL and SUMSVLR to each reach the second predetermined values SUMRL2 and SUMLR2 (YES in steps S11 and S91), but may be performed as soon as the results of temporary determination are obtained. Also, with the embodiments, the internal combustion engine is the engine 3 which is a gasoline engine for vehicles, but may be various industrial internal combustion engines, including for example, diesel engines LPG (Liquid Propane Gas) engines, ship propulsion engines such as outboard motors with the crankshaft situated perpendicularly, and so forth. Additionally, various changes may be made to detailed configurations within the spirit and scope of the disclosure.

An abnormality determining device according to a first aspect of the present disclosure is configured to determine abnormality of an air-fuel ratio sensor O2 sensor 24 in the embodiments (the same hereinafter)) disposed in an exhaust gas passage 6 of an internal combustion engine 3 to detect an exhaust gas air-fuel ratio which is an air-fuel ratio of exhaust gas from the internal combustion engine 3, the abnormality determining device 1 including: an air-fuel ratio control unit (ECU2) configured to selectively control an air-fuel mixture air-fuel ratio which is an air-fuel ratio of an air-fuel mixture of the internal combustion engine 3 to one of a predetermined lean air-fuel ratio, and a predetermined rich air-fuel ratio farther to a rich side as compared to the lean air-fuel ratio; an output change period parameter calculating unit (ECU2, steps S68 and S148) configured to calculate, after the air-fuel ratio control unit performs at least one of switching of the air-fuel mixture air-fuel ratio from the rich air-fuel ratio to the lean air-fuel ratio and switching of the air-fuel mixture air-fuel ratio from the lean air-fuel ratio to the rich air-fuel ratio (YES in step S36, YES in step S117), an output change period parameter (first output change period parameter WDSVO2RL, second output change period parameter WDSVO2LR) representing a period from the amount of change (output change amount DSVO2) of the output of the air-fuel ratio sensor, which changes due to the switching, reaching a predetermined change amount (first predetermined change amount DVREFRL, second predetermined change amount DVREFLR) and then returning to the predetermined change amount; an output change amount extremum calculating unit (ECU2, steps S54 and 134) configured to calculate an output change amount extremum (first output change amount extremum HDSVO2RL, second output change amount extremum HDSVO2LR), which is an extremum of the amount of change of output of the air-fuel ratio sensor, obtained within the period represented by the calculated output change period parameter; and an abnormality determining unit (ECU2, steps S14 through S16, S18, S20, S21, S23, S94 through S96, S98, S100, S101, S103, S201, S202, S211, and S212) configured to determine an abnormality of the air-fuel ratio sensor based on a relationship (first determining parameter KJUDSVO2RL, second determining parameter KJUDSVO2LR) between the output change period parameter and the output change amount extremum.

According to this configuration, abnormality of the air-fuel ratio sensor to detect the exhaust gas air-fuel ratio is determined as follows. That is to say, after at least one of switching of the air-fuel mixture air-fuel ratio from the rich air-fuel ratio to the lean air-fuel ratio and switching of the air-fuel mixture air-fuel ratio from the lean air-fuel ratio to the rich air-fuel ratio is performed, the output change period parameter calculating unit calculates an output change period parameter representing a period from the amount of change of the output of the air-fuel ratio sensor due to the switching (hereinafter also referred to as "output change amount") reaching a predetermined change amount and then returning to the predetermined change amount (hereinafter also referred to as "output change period"). Also, the output change amount extremum calculating unit calculates an output change amount extremum which is an extremum of the amount of change of output of the air-fuel ratio sensor, obtained within the output change period represented by the calculated output change period parameter. Further, the abnormality determining unit determines an abnormality of the air-fuel ratio sensor based on a relationship between the output change period parameter and the output change amount extremum.

Figure 19A:
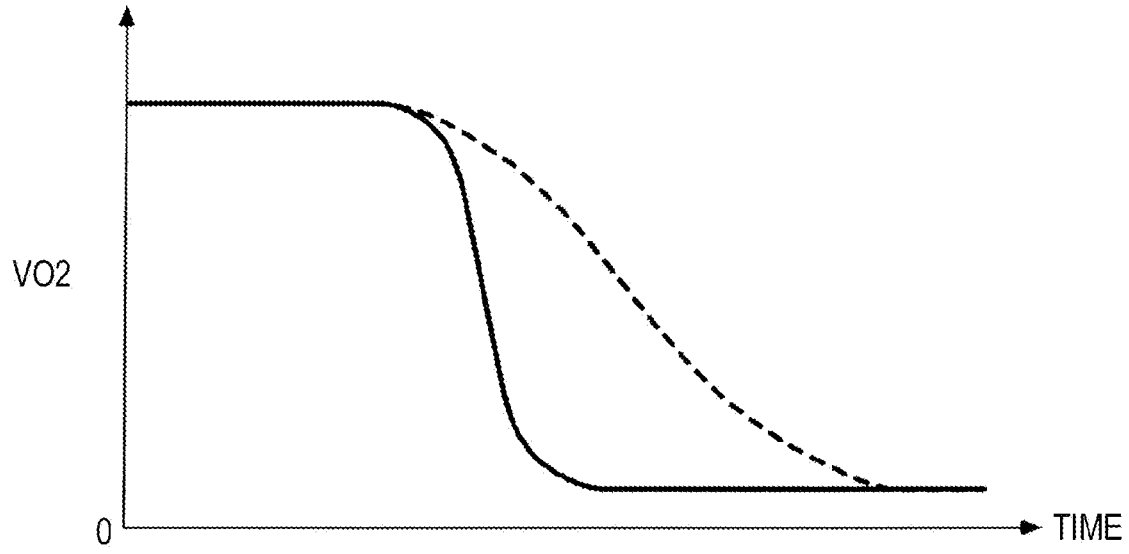
FIGS. 19A and 19B are diagrams illustrating transition in air-fuel ratio sensor output and output change amount according to the present disclosure, for each of a normal and abnormal air-fuel ratio sensor.
Figure 19B:
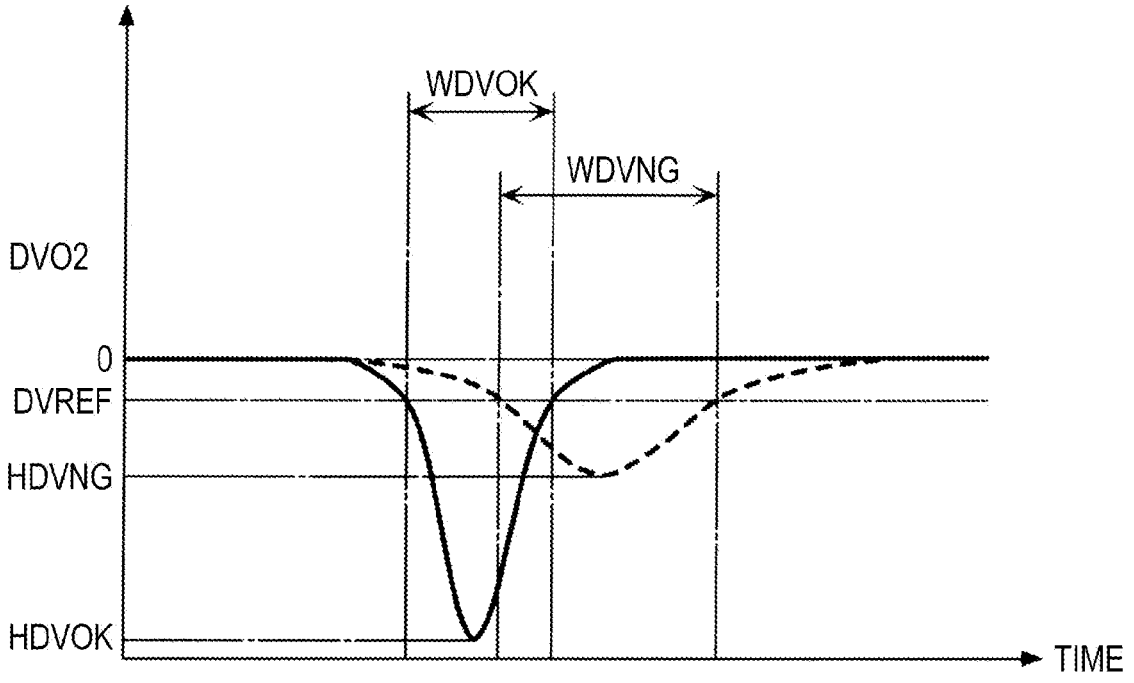

FIGS. 19A and 19B illustrate an example of setting the rich air-fuel ratio and lean air-fuel ratio to the richer side and leaner side of the stoichiometric mixture, respectively, illustrating a case of transition of the output of the air-fuel ratio sensor and output change amount in the case of switching the air-fuel mixture air-fuel ratio from the rich air-fuel ratio to the lean air-fuel ratio. In the drawings, VO2 represents the output of the air-fuel ratio sensor, and DVO2 and DVREF represent output change amount and predetermined change amount, respectively. Also, the solid lines and broken lines in FIGS. 19A and 19B respectively represent a case where the air-fuel ratio sensor is normal and a case where the air-fuel ratio sensor is acting abnormal due to deterioration from age or the like for example. Further, HDVOK and HDVNG represent output change amount extremums for a case where the air-fuel ratio sensor is normal and abnormal respectively, and WDVOK and WDVNG represent output change periods in which the air-fuel ratio sensor is normal and abnormal respectively.

This air-fuel ratio sensor is of a two-value type, and has output properties where the output becomes maximum when the exhaust gas air-fuel ratio is more to the rich side as compared with a predetermined exhaust gas region including a stoichiometric exhaust gas air-fuel ratio equivalent to a stoichiometric mixture of the air-fuel mixture, the output VO2 becomes minimum when on the lean side, and the output change amount DVO2 (absolute value) becomes maximum when the exhaust gas air-fuel ratio is near the stoichiometric exhaust gas air-fuel ratio.

In the event that the air-fuel mixture air-fuel ratio is switched to lean air-fuel ratio as shown in FIGS. 19A and 19B, the output VO2 of the air-fuel ratio sensor changes in accordance with the exhaust gas air-fuel ratio changing accordingly. In the event that the air-fuel ratio sensor is abnormal, the response properties thereof deteriorate as compared with a case of being normal, so the change of the output VO2 of the air-fuel ratio sensor due to switching of the air-fuel mixture air-fuel ratio described above becomes gradual, the output change amount DVO2 becomes smaller, and time required to go from the maximum value corresponding to the rich air-fuel ratio to being stabilized at the minimum value corresponding to the lean air-fuel ratio becomes longer.

As a result, in the event that the air-fuel ratio sensor is abnormal, the output change amount extremum HDVNG becomes smaller as the output change period WDVNG becomes longer, as compared with a normal case. This is not restricted to a case of the air-fuel mixture air-fuel ratio being switched to a lean air-fuel ratio; it also applies to a case of being switched to a rich air-fuel ratio. This also holds true in the case of using a type of sensor which linearly detects the exhaust gas air-fuel ratio over a wide range of air-fuel mixture air-fuel ratio regions from a region richer than the stoichiometric mixture to an extremely lean region, instead of the above-described two-value type. From the above, it can be seen that abnormalities of the air-fuel ratio sensor can be accurately determined based on the relationship between the output change period and output change amount extremum.

Figure 20A:
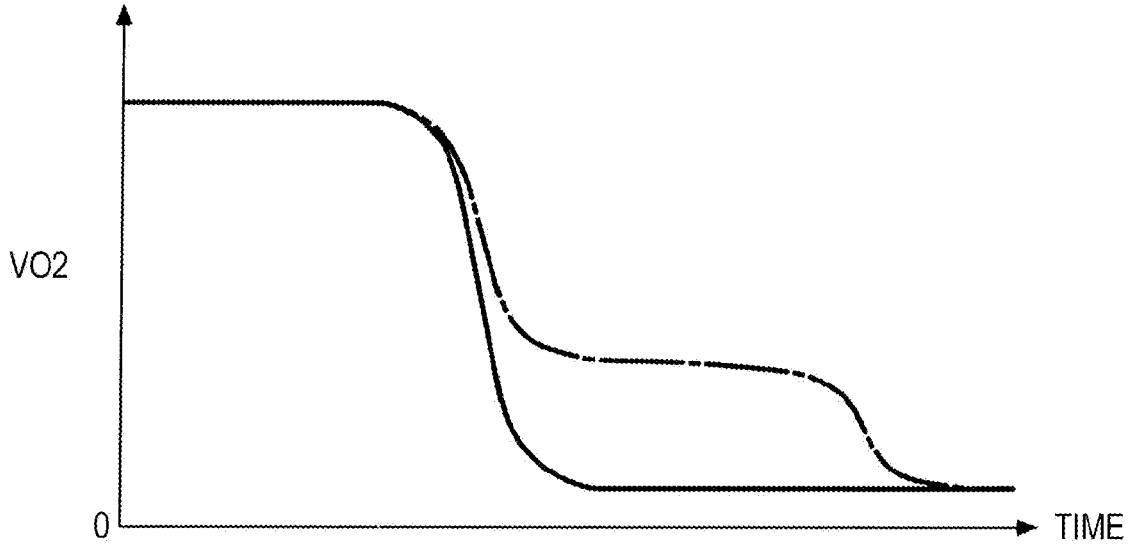
FIGS. 20A and 20B are diagrams illustrating transition in air-fuel ratio sensor output and output change amount according to the present disclosure, for each of a case where lag in exhaust gas air-fuel ratio has and has not occurred.
Figure 20B:
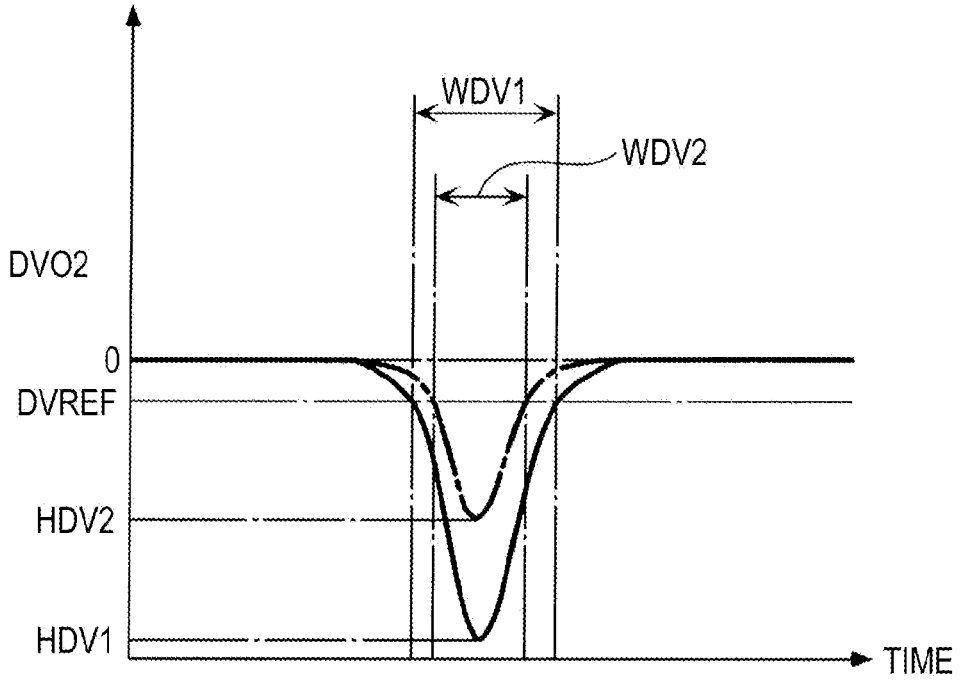

Also, FIGS. 20A and 20B illustrate an example transition of the output VO2 of the air-fuel ratio sensor and output change amount DVO2 thereof in the case that the air-fuel ratio sensor is normal, regarding a case of using a two-value air-fuel ratio sensor and setting the rich air-fuel ratio and lean air-fuel ratio the same as with the case in FIGS. 19A and 19B, and switching the air-fuel mixture air-fuel ratio to lean air-fuel ratio.

In FIGS. 20A and 20B, the one-dot broken lines illustrate a case where the exhaust gas air-fuel ratio does not immediately converge at an exhaust gas air-fuel ratio equivalent to lean air-fuel ratio (hereinafter referred to as "lean exhaust gas air-fuel ratio") due to effects of, for example, inconsistency in air-fuel ratio among the multiple cylinders or the internal combustion engine, storage of oxygen at a catalyst provided upstream of the air-fuel ratio sensor, or the like, and there is a lag at a exhaust gas air-fuel ratio on the rich side as compared to the lean exhaust gas air-fuel ratio (hereinafter, this lag will be referred to as "exhaust gas air-fuel ratio lag"). Also, the solid lines indicate a case where this exhaust gas air-fuel ratio lag has not occurred. Further, in FIGS. 20A and 20B, WDV1 and WDV2 respectively represent output change periods of a case where exhaust gas air-fuel ratio lag has occurred and a case where exhaust gas air-fuel ratio lag has not occurred, and HDV1 and HDV2 respectively represent output change amount extremums of a case where exhaust gas air-fuel ratio lag has occurred and a case where exhaust gas air-fuel ratio lag has not occurred.

As indicated by the one-dot broken lines in FIGS. 20A and 20B, in the event that the air-fuel ratio sensor is normal and exhaust gas air-fuel ratio lag occurs, the output VO2 of the air-fuel ratio sensor lags at a value greater than the minimum value, and thereafter converges at the minimum value. In the event that exhaust gas air-fuel ratio lag occurs, the period over which the exhaust gas air-fuel ratio is actually changing due to this exhaust gas air-fuel ratio lag becomes shorter as with a case where exhaust gas air-fuel ratio lag is not occurring (solid line), so the output change period WDV2 becomes shorter and the output change amount extremum also becomes smaller. In this case, unlike the case of the air-fuel ratio sensor abnormality indicated by the broken line in FIGS. 19A and 19B, the response properties of the air-fuel ratio sensor have not deteriorated, so the output change period WDV2 does not become long. As can be seen from above, the output change period and output change amount extremum have a close relationship with each other, so if the air-fuel ratio sensor is normal, a predetermined relationship the same as with a case where no exhaust gas air-fuel ratio lag is occurring will hold between the output change period and output change amount extremum for a case where exhaust gas air-fuel ratio lag is occurring as well.

This is not restricted to a case of the air-fuel mixture air-fuel ratio being switched to a lean air-fuel ratio; it also applies to a case of being switched to a rich air-fuel ratio. This also holds true in the case of using a type of sensor which linearly detects the exhaust gas air-fuel ratio over a wide range of air-fuel mixture air-fuel ratio regions from a region richer than the stoichiometric mixture to an extremely lean region, instead of the above-described two-value type.

From the above, it can be seen that abnormalities of the air-fuel ratio sensor can be accurately determined based on the relationship between the output change period and output change amount extremum even in a case where the output change amount is relatively small due to effects of exhaust gas air-fuel ratio lag. Also, a period from the output change amount reaching a predetermined change amount up to returning to the predetermined change amount again is calculated as the output change period parameter, thereby preventing an abnormality determination from being made based on an output change period in a case where the output of the air-fuel ratio sensor has temporarily slightly fluctuated due to external disturbances such as noise or the like.

Further, the response properties of the air-fuel ratio sensor may differ between when switching the air-fuel mixture air-fuel ratio to the lean air-fuel ratio (hereinafter also referred to as "switching to lean air-fuel ratio") and when switching the air-fuel mixture air-fuel ratio to the rich air-fuel ratio (hereinafter also referred to as "switching to rich air-fuel ratio"). Accordingly, abnormalities in response properties of the air-fuel ratio sensor can be accurately determined for both switching to lean air-fuel ratio and switching to rich air-fuel ratio, by performing abnormality determination of the air-fuel ratio sensor based on the above-described relation between the output change period parameter and output change amount extremum for both.

Note that with the first aspect, the output change amount extremum includes an extremum for output change amount holding a value "0" as a reference, and an extremum for output change amount holding a predetermined change amount stipulating an output change period as a reference.

With the abnormality determining device 1 of the air-fuel ratio sensor, the abnormality determining unit may determine abnormality of the air-fuel ratio sensor (steps S14 through S16, S18, S20, S21, S23, S94 through S96, S98, S100, S101, and S103) based on a ratio of the output change amount extremum as to the output change period parameter (first determining parameter KJUDSVO2RL, second determining parameter KJUDSVO2LR).

According to this configuration, determination of abnormality of the air-fuel ratio sensor can be performed based on the ratio of the output change amount extremum as to the output change period parameter, and accordingly can be suitably performed directly on the relation between the output change period and output change amount extremum.

With the abnormality determining device 1 of the air-fuel ratio sensor, a catalyst (three-way catalytic converter 7) to cleanse the exhaust gas may be disposed in the exhaust gas passage 6 upstream of the air-fuel ratio sensor, with the air-fuel ratio sensor having output properties such that the amount of change of output as to the exhaust gas air-fuel ratio becomes maximum when the exhaust gas air-fuel ratio is near a stoichiometric exhaust gas air-fuel ratio equivalent to a stoichiometric mixture of air-fuel mixture, and with the lean air-fuel ratio being to the lean side of the stoichiometric mixture and the rich air-fuel ratio being to the rich side of the stoichiometric mixture.

According to this configuration, a catalyst to cleanse the exhaust gas is disposed in the exhaust gas passage upstream of the air-fuel ratio sensor. Accordingly, the above-described exhaust gas air-fuel ratio lag may occur when switching the air-fuel mixture air-fuel ratio between lean air-fuel ratio and rich air-fuel ratio, due to oxygen storage and oxidization at this catalyst. Also, the air-fuel ratio sensor has output properties where the output change amount as to the exhaust gas air-fuel ratio becomes greatest when the exhaust gas air-fuel ratio is near to a stoichiometric exhaust gas air-fuel ratio which is an exhaust gas air-fuel ratio equivalent to a stoichiometric mixture of the air-fuel mixture.

Further, the air-fuel mixture air-fuel ratio is switched between a lean air-fuel ratio leaner than the stoichiometric mixture and a rich air-fuel ratio richer than the stoichiometric mixture, so with the air-fuel ratio sensor having the above-described output properties, the relation between the calculated output change period parameter and output change amount extremum expresses whether or not there is any abnormality of the air-fuel ratio sensor. Accordingly, the above-described advantage, i.e., the advantage that abnormality of the air-fuel ratio sensor can be accurately determined even in the event that the amount of change of the exhaust gas air-fuel ratio is small due to the effects of the exhaust gas air-fuel ratio lag, can be effectively obtained.

Also, even in the event that there are inconsistencies in exhaust gas air-fuel ratio among the cylinders, the exhaust gas is mixed at the catalyst, so effects of fluctuation of exhaust gas air-fuel ratio due to such inconsistencies on abnormality determination can be suppressed.

The abnormality determining device 1 may further include: an exhaust gas flow volume accumulation value calculating unit (ECU, steps S37 and S118) configured to calculate an exhaust gas flow volume accumulation value (first exhaust gas flow accumulation value SUMSVRL, second exhaust gas flow accumulation value SUMSVLR) which is an accumulation value of the flow volume of exhaust gas; with the air-fuel ratio control unit controlling the air-fuel mixture air-fuel ratio to the lean air-fuel ratio by executing fuel cutoff operation in which supply of fuel to the internal combustion engine 3 is stopped during operation of the internal combustion engine 3, and controlling the air-fuel mixture air-fuel ratio to the rich air-fuel ratio by supplying fuel to the internal combustion engine 3 upon ending the fuel cutoff operation; and with the abnormality determining unit finalizing determination of abnormality of the air-fuel ratio sensor (steps S20, S21, S23, S100, S101, and S103) in the event that, before elapsing of at least one determining period of a first determining period from the exhaust gas flow volume accumulation value after starting the fuel cutoff operation reaching a first predetermined value SUMRL1 (YES in step S39) up to reaching a second predetermined value SUMRL2 (YES in step S11) and a second determining period from the exhaust gas flow volume accumulation value after supply of the fuel being started upon ending of the fuel cutoff operation reaching a third predetermined value (first predetermined value SUMLR1) (YES in step S120) up to reaching a fourth predetermined value (second predetermined value SUMLR2) (YES in step S91), determination of abnormality of the air-fuel ratio sensor based on the relationship between the output change period parameter and the output change amount extremum has ended (YES in step S19, YES in step S99), the finalization being made based on the determination of abnormality, and finalizing determination of abnormality of the air-fuel ratio sensor (Steps S23 and S103) in the event that calculation of the output change period parameter and the output change amount extremum has not been completed (NO in step S19, NO in step S99) upon at least one of the determining periods elapsing.

According to this configuration, the exhaust gas flow volume accumulation value calculating unit calculates an exhaust gas flow volume accumulation value which is an accumulation value of the flow volume of exhaust gas. Also, switching of the air-fuel mixture air-fuel ratio between the lean air-fuel ratio and rich air-fuel ratio is performed using fuel cutoff operation and supply of fuel after ending the fuel cutoff operation. Further, determination of abnormality of the air-fuel ratio sensor is finalized in the event that, before elapsing of at least one determining period of the first determining period and the second determining period, determination of abnormality of the air-fuel ratio sensor based on the relationship between the output change period parameter and the output change amount extremum has ended. In this case, the first determination period is set to a period from the exhaust gas flow volume accumulation value after starting the fuel cutoff operation reaching the first predetermined value up to reaching the second predetermined value, and the second determination period is set to a period from the exhaust gas flow volume accumulation value after supply of the fuel being started upon ending of the fuel cutoff operation reaching the third predetermined value up to reaching the fourth predetermined value.

Thus, after the accumulation value of the exhaust gas flow volume has reached the first predetermined value following starting of the fuel cutoff operation, i.e., following starting of the switching of the air-fuel mixture air-fuel ratio to the lean air-fuel ratio, abnormality of the air-fuel ratio sensor is finalized based on determination results of the air-fuel ratio sensor abnormality obtained at that time. Accordingly, after starting of the switching of the air-fuel mixture air-fuel ratio to the lean air-fuel ratio, abnormality of the air-fuel ratio sensor can be suitably determined while compensating for wasted time from the exhaust gas generated by the air-fuel mixture of the lean air-fuel ratio burning until reaching the air-fuel ratio sensor.

In the same way, after the accumulation value of the exhaust gas flow volume has reached the third predetermined value following ending of the fuel cutoff operation, i.e., following starting of the supply of the fuel along with starting of the switching of the air-fuel mixture air-fuel ratio to the rich air-fuel ratio, abnormality of the air-fuel ratio sensor is finalized based on determination results of the air-fuel ratio sensor abnormality obtained at that time. Accordingly, after starting of the switching of the air-fuel mixture air-fuel ratio to the rich air-fuel ratio, abnormality of the air-fuel ratio sensor can be suitably determined while compensating for wasted time from the exhaust gas generated by the air-fuel mixture of the rich air-fuel ratio burning until reaching the air-fuel ratio sensor.

Also, in the case of an air-fuel ratio sensor abnormality, the output of the air-fuel ratio sensor hardly changes even if a great amount of exhaust gas passes over the air-fuel ratio sensor after starting switching of the air-fuel mixture air-fuel ratio to the rich air-fuel ratio or the lean air-fuel ratio. As a result, at calculation of at least one of the output change period parameter and output change amount extremum will not be completed. With the configuration described above, in the event that calculation of the output change period parameter and output change amount extremum is not completed in the event that at least one determination period has elapsed, determination that there is an air-fuel ratio sensor abnormality is finalized.

Thus, in the event that calculation of the output change period parameter and output change amount extremum is not completed even after the accumulation value of the exhaust gas flow volume exceeds the second predetermined value after starting switching of the air-fuel mixture air-fuel ratio to the lean air-fuel ratio, i.e., even after a great amount of exhaust gas has passed over the air-fuel ratio sensor, determination that there is an air-fuel ratio sensor abnormality is finalized, so abnormality of the air-fuel ratio sensor can be accurately determined. In the same way, in the event that calculation of the output change period parameter and output change amount extremum is not completed even after the accumulation value of the exhaust gas flow volume exceeds the fourth predetermined value after starting switching of the air-fuel mixture air-fuel ratio to the rich air-fuel ratio, i.e., even after a great amount of exhaust gas has passed over the air-fuel ratio sensor, determination that there is an air-fuel ratio sensor abnormality is finalized, so abnormality of the air-fuel ratio sensor can be accurately determined.

With the abnormality determining device 1, in the event that the output of the air-fuel ratio sensor obtained at the point that the amount of change of output (first peak output SVO2PKRL, second peak output SVO2PKLR) of the air-fuel ratio sensor reaches the extremum following the switching of the air-fuel mixture air-fuel ratio having been performed is not within a predetermined range (NO in step S175, NO in step S195), the abnormality determining unit suspends abnormality determination of the air-fuel ratio sensor (steps S174, S163, S194, and S183).

In the event that the above-described exhaust gas air-fuel ratio lag does not occur when the air-fuel mixture air-fuel ratio is changed between the lean air-fuel ratio and rich air-fuel ratio, normally the change amount of the exhaust gas air-fuel ratio is greatest at the point that the exhaust gas air-fuel ratio is at a predetermined exhaust gas air-fuel ratio between the exhaust gas air-fuel ratio corresponding to the lean air-fuel ratio and the exhaust gas air-fuel ratio corresponding to the rich air-fuel ratio. Accordingly, in the event that no exhaust gas air-fuel ratio lag is occurring, the output change amount of the air-fuel ratio sensor reaches the extremum at the point that the exhaust gas air-fuel ratio represented by the output of the air-fuel ratio sensor is the predetermined exhaust gas air-fuel ratio.

As can be clearly understood from this, in the event that the exhaust gas air-fuel ratio represented by the output of the air-fuel ratio sensor obtained at the point that the amount of change of the output of the air-fuel ratio sensor following switching of the air-fuel mixture air-fuel ratio reaches the extremum is not the above predetermined exhaust gas air-fuel ratio, there is possibility that exhaust gas air-fuel ratio lag is occurring. Further, in this case, there are cases wherein the amount of change of the exhaust gas air-fuel ratio will be extremely small, in the event that the exhaust gas air-fuel ratio is not within a predetermined exhaust gas air-fuel ratio range including the predetermined exhaust gas air-fuel ratio, due to lag of the exhaust gas air-fuel ratio without any change immediately following switching of the air-fuel mixture air-fuel ratio. In this case, even in the event that abnormality is determined based on the above-described relation between the output change period parameter and output change amount extremum, there is the concern that a normal air-fuel ratio sensor may be erroneously determined to be abnormal. Hereinafter, the exhaust gas air-fuel ratio lag occurred immediately after switching will also be referred to as "exhaust gas air-fuel ratio lag immediately following switching".

According to the above-described configuration, in the event that the output of the air-fuel ratio sensor obtained at the point that the output change amount of the air-fuel ratio sensor has reached the extremum, following switching of the air-fuel mixture air-fuel ratio to at least one of the lean air-fuel ratio and rich air-fuel ratio, is not within the predetermined range, abnormality determination of the air-fuel ratio sensor is suspended. Accordingly, abnormality determination of the air-fuel ratio sensor can be suspended while exhaust gas air-fuel ratio lag is occurring immediately after switching, by setting this predetermined range to a range corresponding to the above-described predetermined exhaust gas air-fuel ratio range, and accordingly the above-described erroneous determination can be prevented.

With the abnormality determining device 1, in the event that a plurality of the output change amount extremums are calculated during abnormality determination of the air-fuel ratio sensor (YES in step S173, YES in step S193), the abnormality determining unit suspends abnormality determination of the air-fuel ratio sensor (steps S174, S163, S194, and S183).

As already mentioned above, in the event that exhaust gas air-fuel ratio lag occurs immediately after switching, there is the concern that a normal air-fuel ratio sensor may be erroneously determined to be abnormal. Also, in the event that exhaust gas air-fuel ratio lag occurs immediately after switching, the output of the air-fuel ratio sensor exhibits lag, change again, and thereafter stabilizing, so multiple extremums of the output change amount occur.

With the above-described configuration, in the event that multiple output change amount extremums are calculated during abnormality detection of the air-fuel ratio sensor, i.e., in the event that multiple extremums of the output change amount are calculated, abnormality determination of the air-fuel ratio sensor is suspended, so the above-described erroneous determination can be prevented.

With the abnormality determining device 1, the abnormality determining unit may determine abnormality of the air-fuel ratio sensor (steps S201, S202, S16, S18, S20, S21, S23, S211, S212, S96, S98, S100, S101, and S103) based on one of a comparison result between a first threshold value (first determining threshold HDREFRL, second determining threshold HDREFLR) calculated based on the output change period parameter and the output change amount extremum, and a comparison result between a second threshold value calculated based on the output change amount extremum and the output change period parameter.

According to this configuration, abnormality of the air-fuel ratio sensor is determined based on one of a comparison result between the first threshold value calculated based on the output change period parameter and the output change amount extremum and a comparison result between the second threshold value calculated based on the output change amount extremum and the output change period parameter. Accordingly, determination of abnormality of the air-fuel ratio sensor can be performed suitably based on the relation between the output change period parameter and output change amount extremum.

Obviously, numerous modifications and variations of the present invention are possible in light of the above teachings. It is therefore to be understood that within the scope of the appended claims, the invention may be practiced otherwise than as specifically described herein.

What is claimed is:

1. An abnormality determining apparatus comprising:

an air-fuel ratio controller configured to control an air-fuel mixture air-fuel ratio which is an air-fuel ratio of an air-fuel mixture of an internal combustion engine to be selectively either one of a predetermined lean air-fuel ratio, or a predetermined rich air-fuel ratio farther to a rich side as compared to the predetermined lean air-fuel ratio;

an output change period parameter calculator configured to calculate, after the air-fuel ratio controller performs at least one of first switching of the air-fuel mixture air-fuel ratio from the predetermined rich air-fuel ratio to the predetermined lean air-fuel ratio and second switching of the air-fuel mixture air-fuel ratio from the predetermined lean air-fuel ratio to the predetermined rich air-fuel ratio, an output change period parameter representing a period from a timing at which an amount of change of output of an air-fuel ratio sensor reaches a predetermined amount of change to a timing at which the amount of change of output of the air-fuel ratio sensor returns to the predetermined amount of change, the output of the air-fuel ratio sensor being to change due to at least one of the first switching and the second switching, the air-fuel ratio sensor being disposed in an exhaust gas passage of the internal combustion engine to detect an exhaust gas air-fuel ratio which is an air-fuel ratio of exhaust gas from the internal combustion engine;

an output change amount extremum calculator configured to calculate an output change amount extremum obtained within the period represented by the output change period parameter calculated by the output change period parameter calculator, the output change amount extremum including an extremum of the amount of change of output of the air-fuel ratio sensor; and an abnormality determining device configured to determine an abnormality of the air-fuel ratio sensor based on a relationship between the output change period parameter and the output change amount extremum.

2. The abnormality determining apparatus according to claim 1, wherein the abnormality determining device is configured to determine abnormality of the air-fuel ratio sensor based on a ratio of the output change amount extremum as to the output change period parameter.

3. The abnormality determining apparatus according to claim 2, wherein a catalyst to cleanse the exhaust gas is disposed in the exhaust gas passage upstream of the air-fuel ratio sensor, wherein the air-fuel ratio sensor has output properties such that the amount of change of output as to the exhaust gas air-fuel ratio becomes maximum when the exhaust gas air-fuel ratio is near a stoichiometric exhaust gas air-fuel ratio equivalent to a stoichiometric mixture of air-fuel mixture, and wherein the predetermined lean air-fuel ratio is on a lean side of the stoichiometric mixture, and the predetermined rich air-fuel ratio is on a rich side of the stoichiometric mixture.

4. The abnormality determining apparatus according to claim 3, further comprising:

an exhaust gas flow volume accumulation value calculator configured to calculate an exhaust gas flow volume accumulation value representing an accumulation value of flow volume of exhaust gas, wherein the air-fuel ratio controller is configured to control the air-fuel mixture air-fuel ratio to be the predetermined lean air-fuel ratio by executing fuel cutoff operation in which supply of fuel to the internal combustion engine is stopped during operation of the internal combustion engine, wherein the air-fuel ratio controller is configured to control the air-fuel mixture air-fuel ratio to the predetermined rich air-fuel ratio by supplying fuel to the internal combustion engine upon ending the fuel cutoff operation, wherein, in an event that, before elapsing of at least one of a first determining period and a second determining period, determination of abnormality of the air-fuel ratio sensor based on the relationship between the output change period parameter and the output change amount extremum has ended, the abnormality determining device finalizes determination of abnormality of the air-fuel ratio sensor based on a latest result of determination of abnormality when determination of abnormality ends, wherein the first determining period is a period from a timing at which the exhaust gas flow volume accumulation value after the fuel cutoff operation is started reaches a first predetermined value to a timing at which the exhaust gas flow volume accumulation value reaches a second predetermined value, wherein the second determining period is a period from a timing at which the exhaust gas flow volume accumulation value after supply of the fuel is started upon ending of the fuel cutoff operation reaches a third predetermined value to a timing at which the exhaust gas flow volume accumulation value reaches a fourth predetermined value, and wherein the abnormality determining device finalizes determination of abnormality of the air-fuel ratio sensor in an event that calculation of the output change period parameter and the output change amount extremum has not been completed if at least one of the first and second determining periods has elapsed.

5. The abnormality determining apparatus according to claim 4, wherein, in an event that the output of the air-fuel ratio sensor obtained at a point that the amount of change of output of the air-fuel ratio sensor reaches an extremum following at least one of the first switching and the second switching of the air-fuel mixture air-fuel ratio having been performed is not within a predetermined range, the abnormality determining device suspends determination of abnormality of the air-fuel ratio sensor.

6. The abnormality determining apparatus according to claim 5, wherein, in an event that a plurality of the output change amount extremums are calculated during determination of abnormality of the air-fuel ratio sensor, the abnormality determining device suspends determination of abnormality of the air-fuel ratio sensor.

7. The abnormality determining apparatus according to claim 4, wherein, in an event that a plurality of the output change amount extremums are calculated during determination of abnormality of the air-fuel ratio sensor, the abnormality determining device suspends determination of abnormality of the air-fuel ratio sensor.

8. The abnormality determining apparatus according to claim 2, further comprising:

an exhaust gas flow volume accumulation value calculator configured to calculate an exhaust gas flow volume accumulation value representing an accumulation value of flow volume of exhaust gas, wherein the air-fuel ratio controller is configured to control the air-fuel mixture air-fuel ratio to be the predetermined lean air-fuel ratio by executing fuel cutoff operation in which supply of fuel to the internal combustion engine is stopped during operation of the internal combustion engine, wherein the air-fuel ratio controller is configured to control the air-fuel mixture air-fuel ratio to the predetermined rich air-fuel ratio by supplying fuel to the internal combustion engine upon ending the fuel cutoff operation, wherein, in an event that, before elapsing of at least one of a first determining period and a second determining period, determination of abnormality of the air-fuel ratio sensor based on the relationship between the output change period parameter and the output change amount extremum has ended, the abnormality determining device finalizes determination of abnormality of the air-fuel ratio sensor based on a result of determination of abnormality when determination of abnormality ends, wherein the first determining period is a period from a timing at which the exhaust gas flow volume accumulation value after the fuel cutoff operation is started reaches a first predetermined value to a timing at which the exhaust gas flow volume accumulation value reaches a second predetermined value, wherein the second determining period is a period from a timing at which the exhaust gas flow volume accumulation value after supply of the fuel is started upon ending of the fuel cutoff operation reaches a third predetermined value to a timing at which the exhaust gas flow volume accumulation value reaches a fourth predetermined value, and wherein the abnormality determining device finalizes determination of abnormality of the air-fuel ratio sensor in an event that calculation of the output change period parameter and the output change amount extremum has not been completed if at least one of the first and second determining periods has elapsed.

9. The abnormality determining apparatus according to claim 8, wherein, in an event that the output of the air-fuel ratio sensor obtained at a point that the amount of change of output of the air-fuel ratio sensor reaches an extremum following at least one of the first switching and the second switching of the air-fuel mixture air-fuel ratio having been performed is not within a predetermined range, the abnormality determining device suspends determination of abnormality of the air-fuel ratio sensor.

10. The abnormality determining apparatus according to claim 8, wherein, in an event that a plurality of the output change amount extremums are calculated during determination of abnormality of the air-fuel ratio sensor, the abnormality determining device suspends determination of abnormality of the air-fuel ratio sensor.

11. The abnormality determining apparatus according to claim 2, wherein, in an event that the output of the air-fuel ratio sensor obtained at a point that the amount of change of output of the air-fuel ratio sensor reaches an extremum following at least one of the first switching and the second switching of the air-fuel mixture air-fuel ratio having been performed is not within a predetermined range, the abnormality determining device suspends determination of abnormality of the air-fuel ratio sensor.

12. The abnormality determining apparatus according to claim 2, wherein, in an event that a plurality of the output change amount extremums are calculated during determination of abnormality of the air-fuel ratio sensor, the abnormality determining device suspends determination of abnormality of the air-fuel ratio sensor.

13. The abnormality determining apparatus according to claim 1, wherein a catalyst to cleanse the exhaust gas is disposed in the exhaust gas passage upstream of the air-fuel ratio sensor, wherein the air-fuel ratio sensor has output properties such that the amount of change of output as to the exhaust gas air-fuel ratio becomes maximum when the exhaust gas air-fuel ratio is near a stoichiometric exhaust gas air-fuel ratio equivalent to a stoichiometric mixture of air-fuel mixture, and wherein the predetermined lean air-fuel ratio is on a lean side of the stoichiometric mixture, and the predetermined rich air-fuel ratio is on a rich side of the stoichiometric mixture.

14. The abnormality determining apparatus according to claim 1, further comprising:

an exhaust gas flow volume accumulation value calculator configured to calculate an exhaust gas flow volume accumulation value representing an accumulation value of flow volume of exhaust gas, wherein the air-fuel ratio controller is configured to control the air-fuel mixture air-fuel ratio to be the predetermined lean air-fuel ratio by executing fuel cutoff operation in which supply of fuel to the internal combustion engine is stopped during operation of the internal combustion engine, wherein the air-fuel ratio controller is configured to control the air-fuel mixture air-fuel ratio to the predetermined rich air-fuel ratio by supplying fuel to the internal combustion engine upon ending the fuel cutoff operation, wherein, in an event that, before elapsing of at least one of a first determining period and a second determining period, determination of abnormality of the air-fuel ratio sensor based on the relationship between the output change period parameter and the output change amount extremum has ended, the abnormality determining device finalizes determination of abnormality of the air-fuel ratio sensor based on a result of determination of abnormality when determination of abnormality ends, wherein the first determining period is a period from a timing at which the exhaust gas flow volume accumulation value after the fuel cutoff operation is started reaches a first predetermined value to a timing at which the exhaust gas flow volume accumulation value reaches a second predetermined value, wherein the second determining period is a period from a timing at which the exhaust gas flow volume accumulation value after supply of the fuel is started upon ending of the fuel cutoff operation reaches a third predetermined value to a timing at which the exhaust gas flow volume accumulation value reaches a fourth predetermined value, and wherein the abnormality determining device finalizes determination of abnormality of the air-fuel ratio sensor in an event that calculation of the output change period parameter and the output change amount extremum has not been completed if at least one of the first and second determining periods has elapsed.

15. The abnormality determining apparatus according to claim 14, wherein, in an event that the output of the air-fuel ratio sensor obtained at a point that the amount of change of output of the air-fuel ratio sensor reaches an extremum following at least one of the first switching and the second switching of the air-fuel mixture air-fuel ratio having been performed is not within a predetermined range, the abnormality determining device suspends determination of abnormality of the air-fuel ratio sensor.

16. The abnormality determining apparatus according to claim 14, wherein, in an event that a plurality of the output change amount extremums are calculated during determination of abnormality of the air-fuel ratio sensor, the abnormality determining device suspends determination of abnormality of the air-fuel ratio sensor.

17. The abnormality determining apparatus according to claim 1, wherein, in an event that the output of the air-fuel ratio sensor obtained at a point that the amount of change of output of the air-fuel ratio sensor reaches an extremum following at least one of the first switching and the second switching of the air-fuel mixture air-fuel ratio having been performed is not within a predetermined range, the abnormality determining device suspends determination of abnormality of the air-fuel ratio sensor.

18. The abnormality determining apparatus according to claim 1, wherein, in an event that a plurality of the output change amount extremums are calculated during determination of abnormality of the air-fuel ratio sensor, the abnormality determining device suspends determination of abnormality of the air-fuel ratio sensor.

19. The abnormality determining apparatus according to claim 1, wherein abnormality determining device determines abnormality of the air-fuel ratio sensor based on one of a comparison result between a first threshold value calculated based on the output change period parameter and the output change amount extremum, and a comparison result between a second threshold value calculated based on the output change amount extremum and the output change period parameter.

* * * * *